US010016634B2

(12) United States Patent
Weston et al.

(10) Patent No.: US 10,016,634 B2
(45) Date of Patent: Jul. 10, 2018

(54) CONTINUOUS SAFETY OR BELAY SYSTEM

(71) Applicant: Whitewater West Industries Ltd., Richmond (CA)

(72) Inventors: Mark Weston, Wakefield, RI (US); Anthony Marinakis, North Vancouver (CA); Rick Briggs, Springfield, IL (US); Hyuma Franskowski, Vancouver (CA); Greg MacDougall, North Vancouver (CA)

(73) Assignee: Whitewater West Industries Ltd., Richmond, B.C. (CA)

( * ) Notice: Subject to any disclaimer, the term of this patent is extended or adjusted under 35 U.S.C. 154(b) by 516 days.

(21) Appl. No.: 14/502,950

(22) Filed: Sep. 30, 2014

(65) Prior Publication Data

US 2015/0090148 A1 Apr. 2, 2015

Related U.S. Application Data

(60) Provisional application No. 61/884,910, filed on Sep. 30, 2013.

(51) Int. Cl.
*A62B 35/00* (2006.01)
*A63G 21/20* (2006.01)

(52) U.S. Cl.
CPC ..... *A62B 35/0062* (2013.01); *A62B 35/0081* (2013.01); *A62B 35/0087* (2013.01); *A63G 21/20* (2013.01)

(58) Field of Classification Search
CPC ..... A62B 35/0062; A62B 35/0068; A62B 35/0075; A62B 35/0081; A62B 21/20
See application file for complete search history.

(56) References Cited

U.S. PATENT DOCUMENTS

| | | | |
|---|---|---|---|
| 5,820,471 | A | 10/1998 | Briggs |
| 5,865,680 | A | 2/1999 | Briggs |
| 6,360,669 | B1 | 3/2002 | Albrich |
| 6,569,023 | B1 | 5/2003 | Briggs |
| 6,761,637 | B2 | 7/2004 | Weston et al. |
| 7,175,534 | B2 | 2/2007 | Liggett |
| 7,309,302 | B1 | 12/2007 | Phillips |

(Continued)

FOREIGN PATENT DOCUMENTS

| | | |
|---|---|---|
| CA | 2762545 | 11/2009 |

OTHER PUBLICATIONS www.spectrumsports.com: webpage showing Rope-A-Phobia; 2004.

*Primary Examiner* — Jason C Smith

(57) ABSTRACT

A bifurcation method and system for a passive continuous belay system that allows for a user to select multiple pathways using intermediate tracks. A main track and the intermediate tracks provide a linear passive continuous belay using an anchor mechanism that is configured to grasp the outside of the structural member track, using rolling elements and/or low-friction sliding. The user may select multiple pathways using intermediate lateral tracks to provide Cartesian movement at designated (e.g., perpendicular) transition or junction points. Desired tracks may be selected by a user via sliding along a support plate or track in a junction box and/or by rotating a portion of the junction box. Amusement attraction activities that include non-harnessed play may be intertwined or located adjacent to activities utilizing harnessed play.

19 Claims, 33 Drawing Sheets

(56) References Cited

U.S. PATENT DOCUMENTS

| | | | | |
|---|---|---|---|---|
| 7,381,137 | B2 | 6/2008 | Steele et al. | |
| 7,416,054 | B2 | 8/2008 | Liggett | |
| 7,614,957 | B2 | 11/2009 | Lickle | |
| 7,699,140 | B2 | 4/2010 | Beggrow | |
| 7,785,207 | B2 | 8/2010 | Henry et al. | |
| 7,819,066 | B2 | 10/2010 | Smith | |
| 8,057,316 | B2 | 5/2011 | Legary et al. | |
| 7,981,004 | B2 | 7/2011 | Liggett et al. | |
| 8,066,578 | B2 | 11/2011 | Liggett | |
| 8,360,937 | B2 | 1/2013 | Liggett | |
| 8,683,925 | B2 | 4/2014 | Liggett | |
| 8,752,668 | B2 * | 6/2014 | Liggett | A63B 71/0054 104/249 |
| 8,807,044 | B2 * | 8/2014 | Liggett | B61B 12/00 104/113 |
| 8,893,852 | B2 * | 11/2014 | Liggett | A62B 35/0075 104/108 |
| 9,782,682 | B2 | 10/2017 | Frankowski et al. | |
| 2006/0189453 | A1 | 8/2006 | Leblonde | |
| 2009/0078148 | A1 | 3/2009 | Cylvick | |
| 2010/0133040 | A1 * | 6/2010 | London | A62B 1/04 182/3 |
| 2012/0125221 | A1 * | 5/2012 | Gustaffson | B61B 13/04 104/89 |
| 2012/0217092 | A1 * | 8/2012 | Jones | A62B 35/0087 182/36 |
| 2013/0327591 | A1 * | 12/2013 | Galpin | A62B 35/0081 182/3 |
| 2015/0090148 | A1 * | 4/2015 | Weston | A63G 21/20 104/91 |
| 2015/0135982 | A1 * | 5/2015 | DeRubes | B62K 9/00 104/107 |
| 2016/0272225 | A1 * | 9/2016 | Liggett | B61H 9/02 |
| 2017/0036123 | A1 | 2/2017 | Liggett | |
| 2017/0043268 | A1 * | 2/2017 | Briggs | A63G 31/02 |

* cited by examiner

CONTINUOUS SAFETY OR BELAY SYSTEM

CROSS REFERENCE TO RELATED APPLICATIONS

This application claims the benefit of U.S. Provisional Patent Application Ser. No. 61/884,910, filed on Sep. 30, 2013, entitled "CONTINUOUS SAFETY OR BELAY SYSTEM," which is hereby incorporated by reference in its entirety.

BACKGROUND

1. Field of the Invention

The present invention relates to amusement attractions. More particularly, the present invention relates to a challenge or rope course with a safety system that permits continuous travel by the user along varying pathways without requiring the user to unhook from the safety system.

2. Description of the Related Art

Ropes courses or other challenge or obstacles courses are a popular entertainment activity for both children and adults. Part of the thrill in traversing many of these courses is the high elevation above the ground that a user travels over, for example, by stepping across along pillars, columns, rope bridges, or the like. In order to increase user safety against falling from such heights and potentially being injured, safety systems have been developed that are worn or otherwise fasten with the user traversing the course that prevents the user from dropping to the ground. For example, many safety systems have taken the form of belts or vests worn by the user that are configured to clamp or fasten with a rope or other securing element to a part of the attraction at one end and to the user at the other end. Thus, even if a user loses their balance or footing while traversing the course, the safety system will keep the user from falling beyond a certain distance, for example, by dangling the user in the air and allowing the user an opportunity to regain their footing.

Unfortunately, traditional ropes courses or other challenge or obstacles courses require the user to traverse only along a linear pathway, without deviation, along the course due to the safety system constraints typically being fastened and movable only along such travel path. The level of excitement of the course may be reduced since freedom to move about the course as may be desired by users is prohibited. Many courses that do allow a user the freedom to choose a travel pathway also require the user to stop their movement on the course at a safe area or position, unhook from the safety system that is connected along the first pathway, and then rehook to the safety system that extends along the desired second pathway. Not only does such a system slow down the number of users that may use the course, but also is inconvenient for users who do not wish to have their play interrupted.

Thus, a safety or belay system is desired that would allow users the freedom to traverse a ropes, challenge, or other obstacle course along a variety of user-chosen pathways without the inconvenience of unhooking/rehooking to the safety or belay system. Such a system would ideally provide a safe means of preventing injury to users, be reliable in operation and low in manufacturing expense while avoiding the above-mentioned deficiencies of conventional safety systems.

SUMMARY

The present invention is related to a continuous safety system for use by participants navigating an aerial challenge course. In one embodiment, a continuous safety system for coupling a user to an amusement attraction may include a first track, a second track that is separate from the first track, a junction box that accepts the first track and the second track, the junction box including a transition surface, and a safety mechanism having a support plate, the safety mechanism configured to couple with the user and travel along the first track, the support plate configured to cooperate with the transition surface of the junction box, wherein the safety mechanism is configured to be moveable between the first track and the second track within the junction box based on the support plate cooperating with the transition surface.

In another embodiment, a safety system for coupling a user to an amusement attraction may include a first track, a second track that is separate from the first track, a junction box that interfaces with the first track and the second track, the junction box including a transition surface, and a safety mechanism having a support plate, the safety mechanism configured to couple with the user and travel along the first track, the support plate configured to cooperate with the transition surface of the junction box, wherein the safety mechanism is configured to be moveable between the first track and the second track within the junction box based on the support plate cooperating with the transition surface.

In still another embodiment, a safety system for coupling a user to an amusement attraction may include an entrance track; a first exit track, a second exit track separate from the first exit track; a pivoting component coupled with the entrance track, the pivoting component configured to transfer between the first exit track or second exit track for providing a track between the entrance track and the first exit track or the entrance track and the second exit track, and a sliding safety mechanism configured to surround at least a portion of the entrance track, the first exit track, the second exit track, or the pivoting component for sliding along the entrance track, the first exit track, the second exit track, or the pivoting component.

In yet another embodiment, a safety system for coupling a user to an amusement attraction may include a first track, a second track separate from the first track, a junction box that interfaces with the first track and the second track, the junction box having a rotating portion containing a support surface, and a safety mechanism configured to couple with the user and travel along the first track or the second track, an exterior surface of the safety mechanism configured to engage with the support surface of the junction box when the safety mechanism is within the rotating portion of the junction box, wherein the safety mechanism is configured to be moveable between the first track and the second track within the junction box by rotating the rotating portion while the safety mechanism is engaged with the support surface.

In yet another embodiment, a method for transferring a trolley on a first track to a second track may include the steps of bringing the first track and the second track within a first predetermined distance of one another, engaging a first latching mechanism coupled with the first track with a second latching mechanism coupled with the second track, engaging the trolley with the second latching mechanism, disengaging the first latching mechanism from the second latching mechanism, and separating the first track from the second track by a second predetermined distance.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
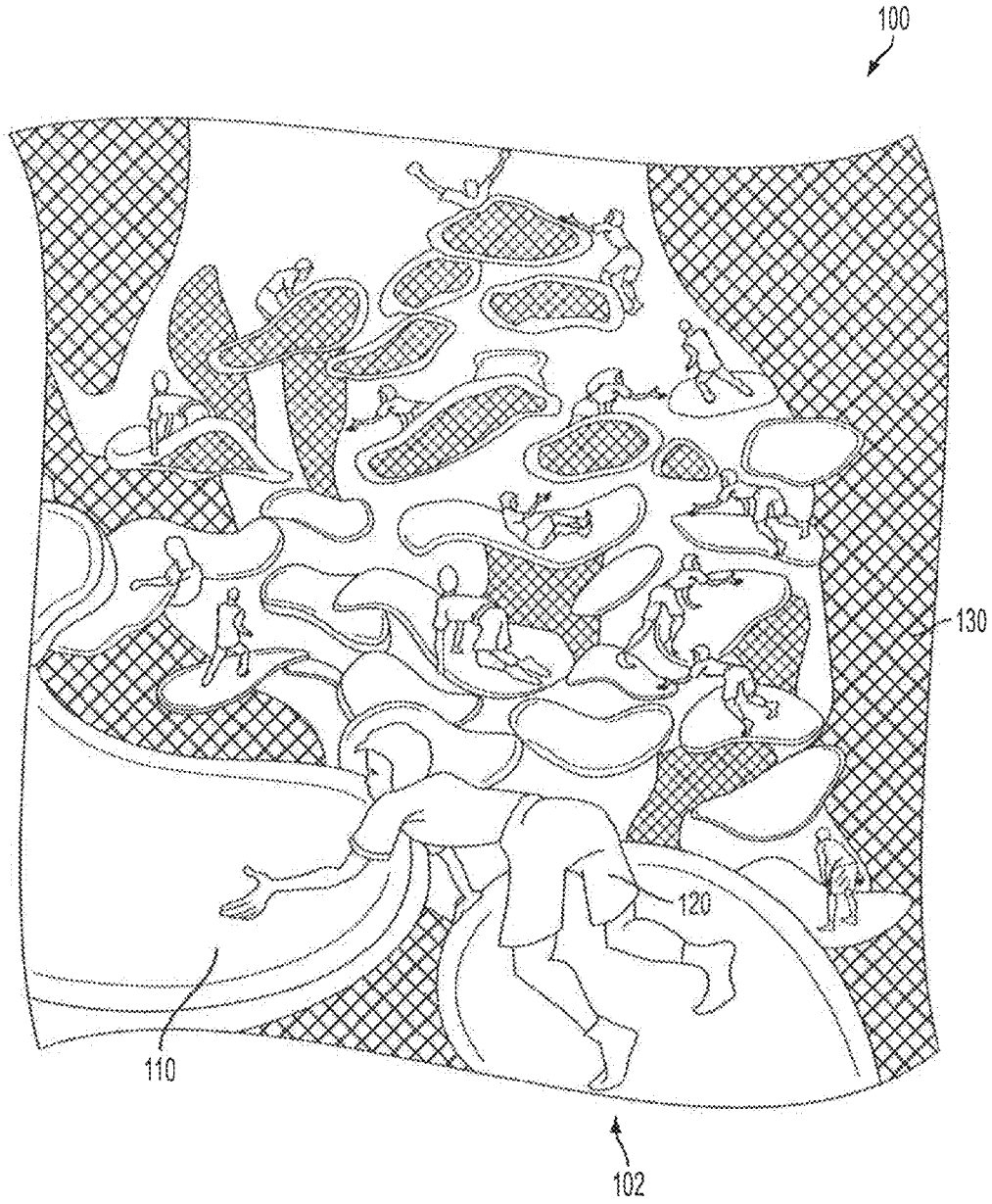
FIG. 1 shows an unharnessed section that may be combined with a harnessed section utilizing a continuous safety or belay system in an amusement attraction according to one embodiment of the present invention.

Turning first to FIG. 1, an amusement attraction 100 is shown, including an unharnessed section 102 (e.g., a series of platforms that users may jump between with a safety netting disposed underneath). As discussed in greater detail herein, the amusement attraction 100 may also include harnessed sections that utilize a continuous safety belay system. In the unharnessed section 102, users are free to traverse the area without the need of a safety system that couples the user to the amusement attraction, for example, to aid in preventing injury. For example, one or more platforms 110 may be spaced apart from one another so that a user 120 may traverse the platforms 110. A safety netting or mesh 130 may be disposed beneath one or more of the platforms 110 such that the user 120 can safely traverse them without risking injury if the user 120 were to fall.

In a harnessed section, users are coupled (e.g., by way of a rope or cloth tether) to the amusement attraction 100 for safety purposes. As discussed in greater detail herein, the continuous safety or belay system may allow users to traverse among multiple pathways, at the users' discretion, without requiring the users to unhook and/or rehook to the safety or belay system. Although FIG. 1 illustrates one potential setup or design for the amusement attraction 100 with an unharnessed section 102 with possible incorporation with a harnessed section, in an alternative embodiment, any of a variety of possible setups or designs may be used. For example, in one embodiment, no unharnessed section 102 may be included as part of the amusement attraction 100.

In one embodiment, different tracks or travel paths may each correspond to a different type of activity or challenge. For example, a first track may include or lead through a rope bridge, a second track may include or lead through a zipline, a third track may include or lead through a vertical drop activity, a fourth track may include or lead through a vertical climbing activity, etc. Thus, a user of the amusement attraction may choose to follow the particular track or travel path that leads to or through the activity or challenge that they desire. Moreover, if one activity is particularly congested by a multitude of users, such user may opt to follow a different track or travel path through a different activity until the congestion clears. Tracks or travel paths may extend throughout the usable space of the amusement attraction (e.g., horizontal or substantially beams or tracks, such as a ropes course, may connect with a vertical ascent, such as a climbing or rock wall, which may connect to a diagonal descent, such as a zip line, which may connect to a diagonal ascent, such as a sloped track, and etc.). In an alternative embodiment, any or all of the above described exemplary combinations or permutations of ride activities or challenges may be included and/or combined with additional ride elements.

The unharnessed section 102 of the amusement attraction 100 may allow users participating within its borders without harnesses to follow, direct, or otherwise interact with those in a harnessed section of the amusement attraction 100. For example, an activity in the unharnessed section 102 may be interwoven in and around activities in the harnessed section so as to create a more exciting or thrilling ride experience for users of both the unharnessed section 102 and the harnessed section. Parents or older users on the harnessed section activities may be able to simultaneously keep an eye on children or younger users in the unharnessed section 102 without being required to idly stand next to the amusement attraction 100.

In one embodiment, users of the unharnessed section 102 may be allowed to interact with ride elements (e.g., buttons, switches, knobs, etc.) that act to modify a portion of the harnessed section (moving platforms, gusts of air, etc.). In certain embodiments, users in the unharnessed section 102 may only be permitted to engage in the activities of the unharnessed section 102 independent of the harnessed section users or activities. I-beams may be used to provide strong, structural support for features or activities in either the harnessed section and/or the unharnessed section 102 (see exemplary dimensional information for such I-beams in FIG. 22).

Figure 2:
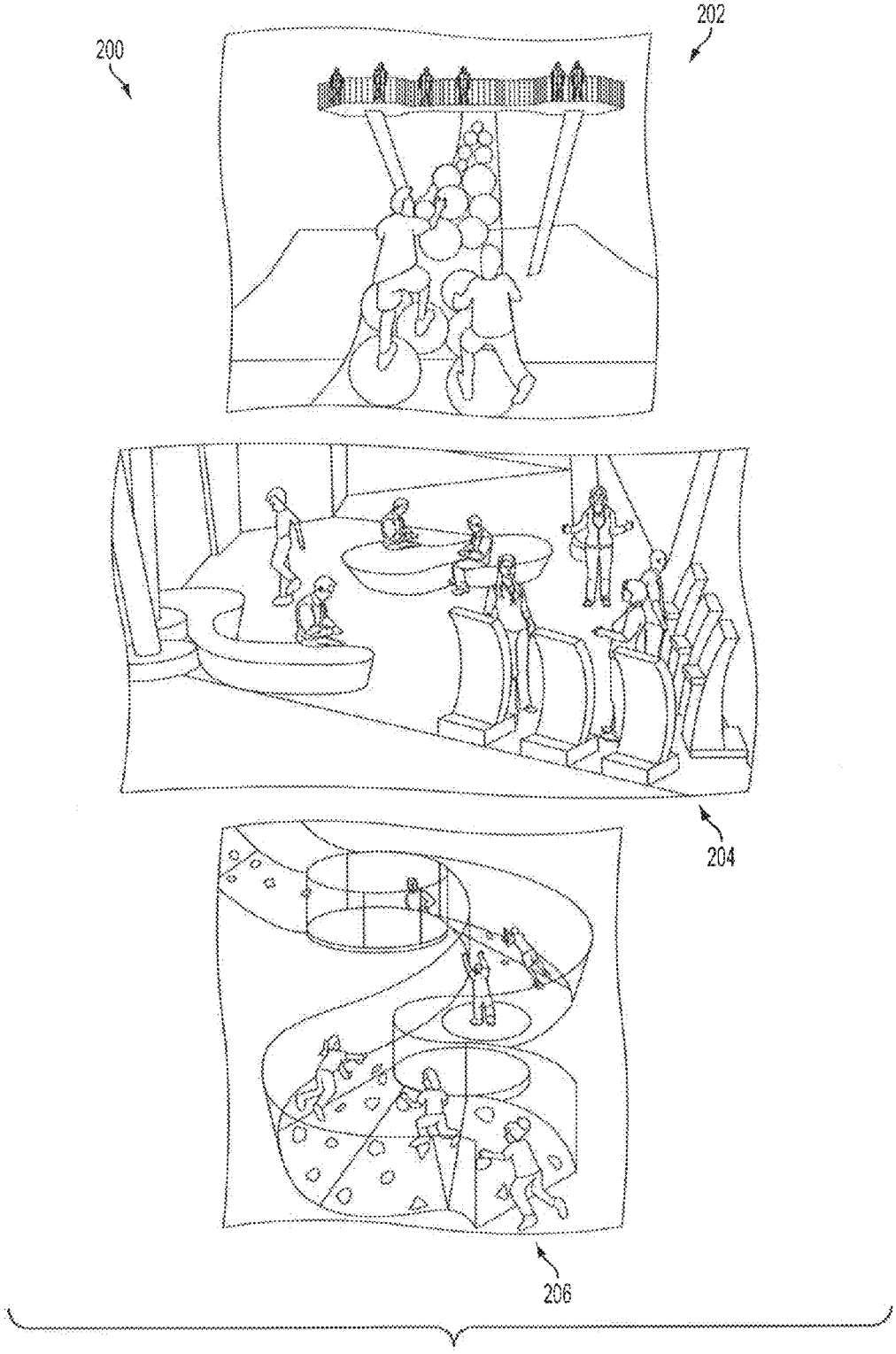
FIG. 2 shows a plurality of views of an unharnessed section that may be combined with a harnessed section utilizing a continuous safety or belay system according to one embodiment of the present invention.

FIG. 2 shows a plurality of views of various unharnessed sections (202, 204, 206) in an amusement attraction 200 (e.g., a series of platforms or bridges that users may traverse across) that may be interwoven with one or more harnessed sections that utilize a continuous safety or belay system, the same as or similar to those discussed above. In the unharnessed sections (202, 204, 206), users are free to traverse the area without the need of a safety system that couples the user to the amusement attraction, for example, to aid in preventing injury. For example, unharnessed section 202 allows users to cross a bridge or sequence of obstacles above a safety netting or mesh. In another example, unharnessed section 204 permits users to participate in activities within an enclosed area having a solid floor and walls. In still another example, unharnessed section 206 permits users to traverse a pathway having walls on either side in order to contain the users for safety purposes.

In a harnessed section, users are coupled to the amusement attraction 200 for safety purposes. As discussed in greater detail herein, the continuous safety or belay system may allow users to traverse among multiple pathways, at the users' discretion, without requiring the users to unhook and/or rehook to the safety or belay system. Although FIG. 2 illustrates one potential setup or design for the amusement attraction 200 that includes the unharnessed sections 202 that may be interwoven or interconnected with a harnessed section, in an alternative embodiment, any of a variety of possible setups or designs may be used.

Figure 3:
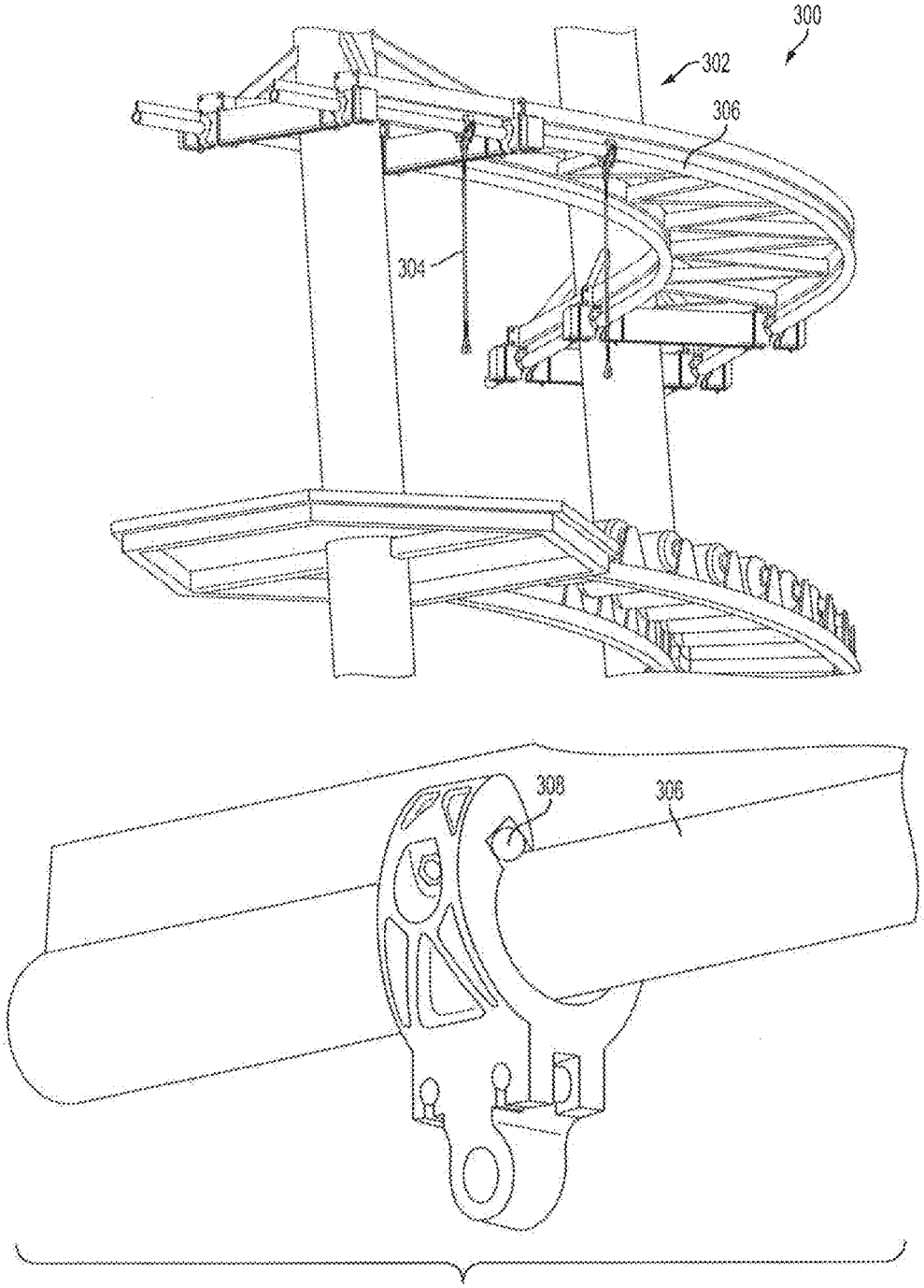
FIG. 3 shows a plurality of views of an amusement attraction including a harnessed section for traversing along play elements and utilizing a continuous safety or belay system according to one embodiment of the present invention.

FIG. 3 shows a plurality of views of an amusement attraction 300 including a harnessed section 302 for traversing along play elements (e.g., along ripe bridges, rope stairs, etc.) and utilizing a continuous safety or belay system, as discussed in greater detail herein. In the harnessed section 302, users are coupled (e.g., via a rope and/or track coupling element) 304 to a track 306 of the amusement attraction 300, for example, for safety purposes. As discussed in greater detail herein, the continuous safety or belay system may allow users to traverse among multiple pathways or tracks, at the users' discretion, without requiring the users to unhook from the coupling 304 and/or re-hook the coupling 304 to a different track segment of the safety or belay system. The coupling element that couples 304 a user to the track 306 may slide along the track 306 or may be configured to roll along the track (e.g., via rollers, wheels, or bearings 308). Although FIG. 3 illustrates one potential setup or design for the amusement attraction 300 that includes the harnessed section 302, in an alternative embodiment, any of a variety of possible setups or designs may be used.

Figure 4:
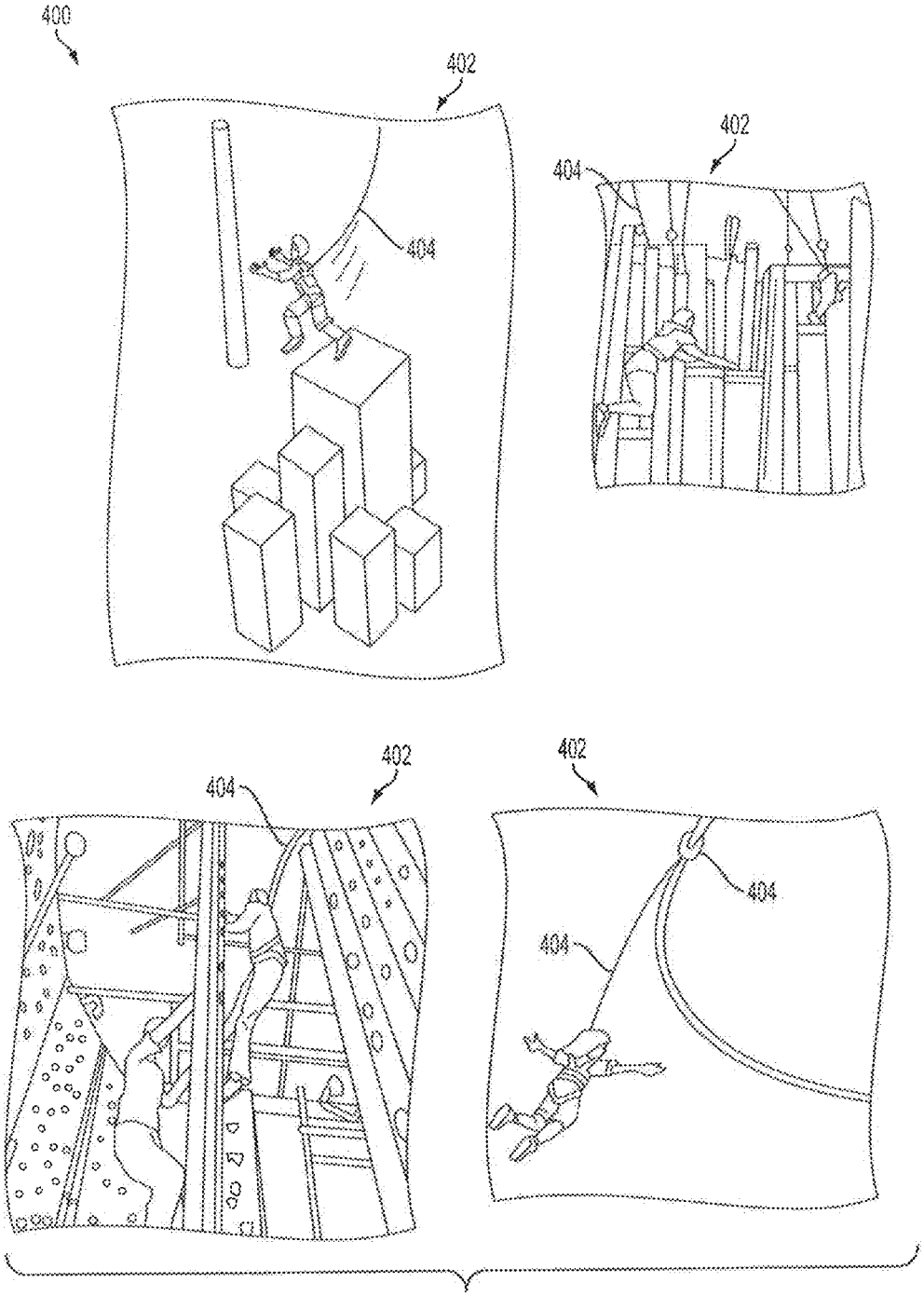
FIG. 4 shows a plurality of views of a harnessed section for an amusement attraction that allows leaping between play elements and utilizing a continuous safety or belay system according to one embodiment of the present invention.

FIG. 4 shows a plurality of views of a harnessed section 402 for an amusement attraction 400 that allows leaping between play elements and utilizing a continuous safety or belay system, as discussed in greater detail herein. For example, a user may be allowed to leap or climb across gaps (e.g., between poles or columns, from one platform to another, etc.) while located at an elevation above a floor or lower surface of the amusement attraction 400. In the harnessed section 402, users are coupled (e.g., via a rope and/or track coupling element) 404 to the amusement attraction 400 for safety purposes. As discussed in greater detail herein, the continuous safety or belay system may allow users to traverse among multiple pathways, at the users' discretion, without requiring the users to unhook and/or rehook to the safety or belay system. Although FIG. 4 illustrates one potential setup or design for the amusement attraction 400 that includes the harnessed section 402, in an alternative embodiment, any of a variety of possible setups or designs may be used.

Figure 5:
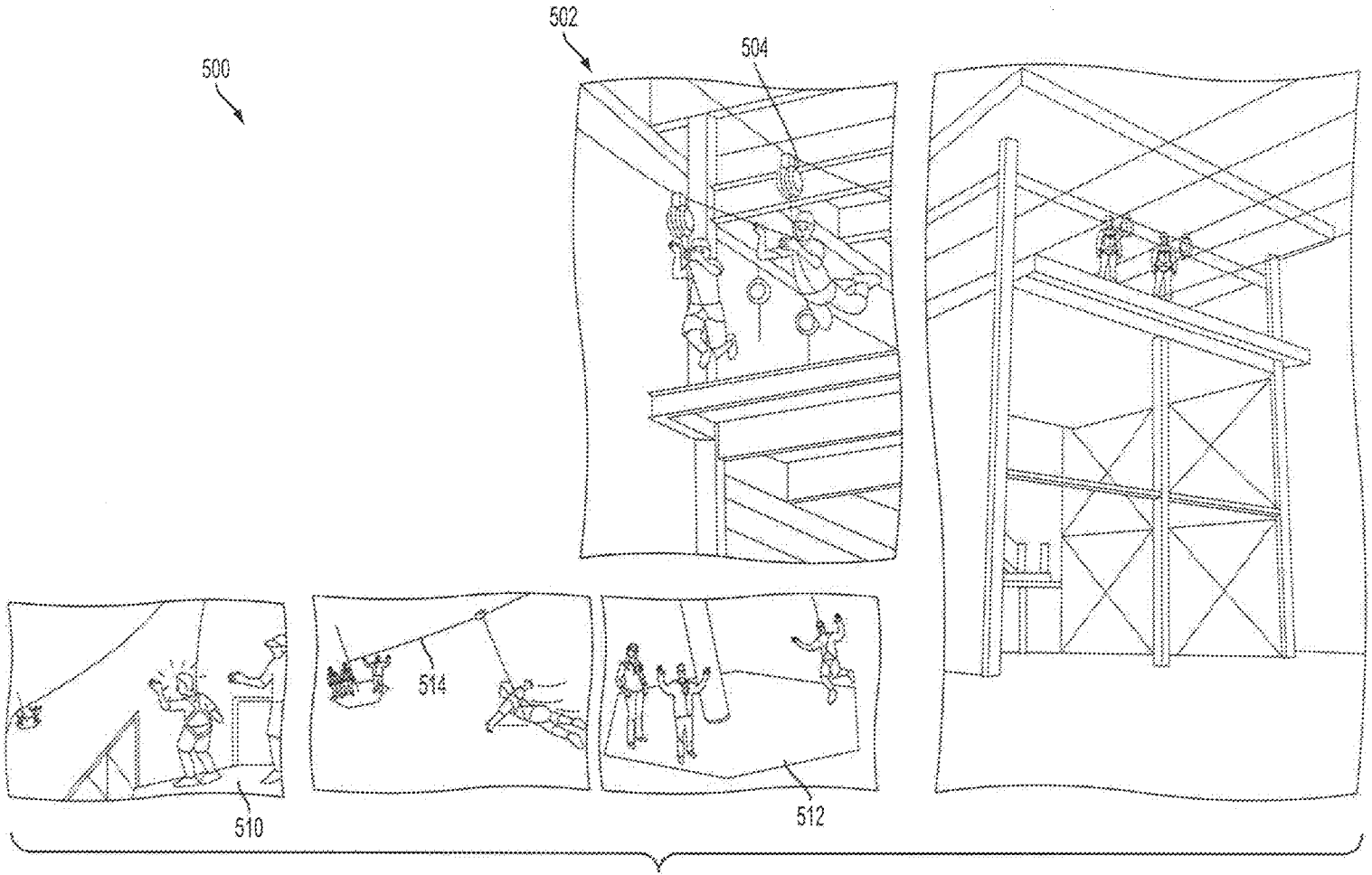
FIG. 5 shows a plurality of views of an amusement attraction including a harnessed section for leaping a large distance between play elements and utilizing a continuous safety or belay system according to one embodiment of the present invention.

FIG. 5 shows a plurality of views of an amusement attraction 500 including harnessed sections 502 utilizing a continuous safety or belay system, as discussed in greater detail herein, that allows a user to leap or slide a long distance across a wide gap (e.g., from a first platform 510 to a second platform 512 located beyond the jumping capabilities of a user, etc.) while located at an elevation above a floor or lower surface of the amusement attraction 500. The user leaps from the first platform 510 and slides or rolls along a zip line or other component 514 towards the second platform 512. In the harnessed section 502, users are coupled (e.g., via a rope and/or track coupling element) 504 to the amusement attraction 500 for safety purposes. As discussed in greater detail herein, the continuous safety or belay system may allow users to traverse among multiple pathways, at the users' discretion, without requiring the users to unhook and/or rehook to the safety or belay system. Although FIG. 5 illustrates one potential setup or design for the amusement attraction 500 that includes the harnessed section 502, in an alternative embodiment, any of a variety of possible setups or designs may be used.

Figure 6:
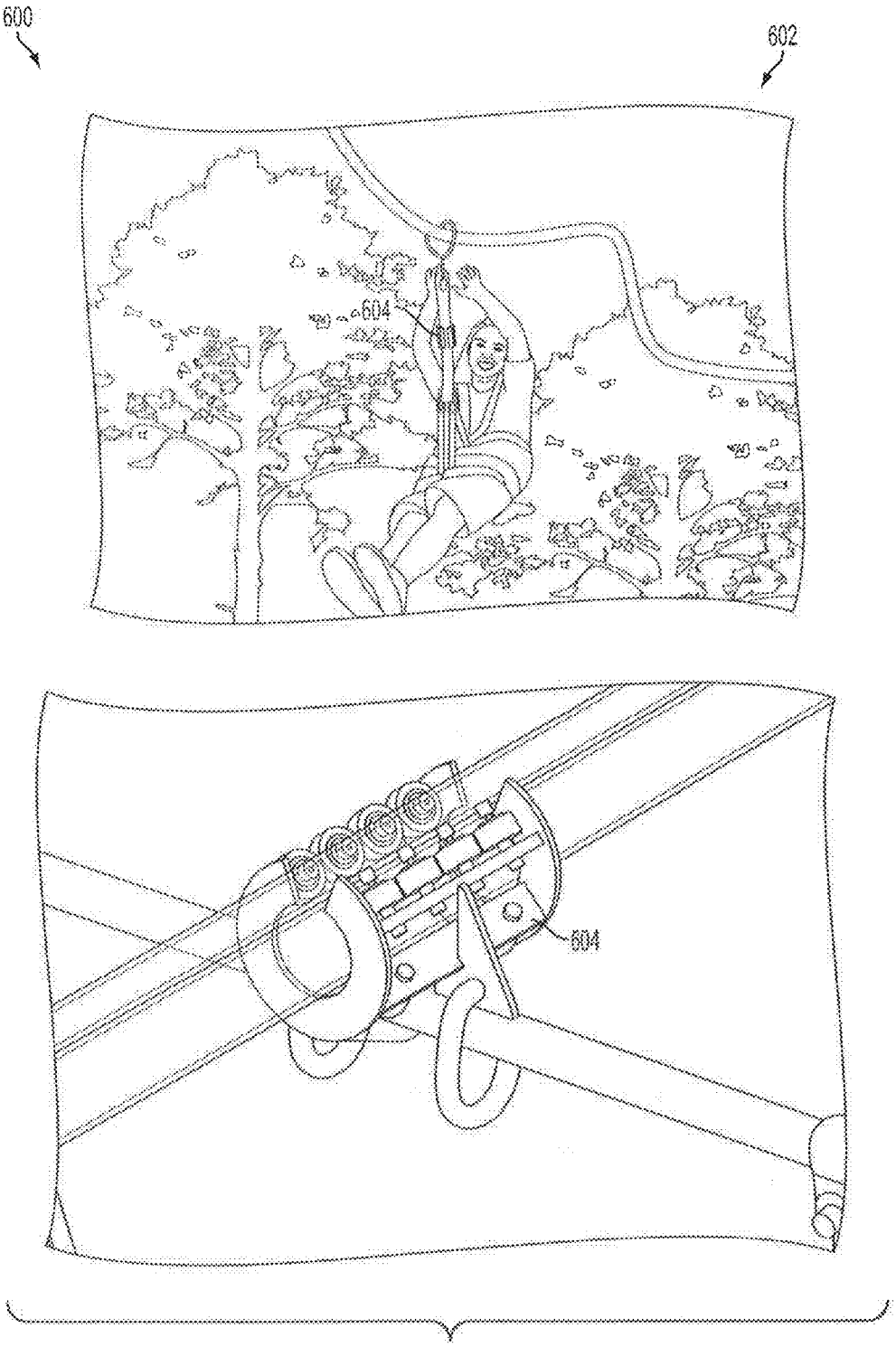
FIG. 6 shows a plurality of views of an amusement attraction including a harnessed section incorporating a zipline and utilizing a continuous safety or belay system according to one embodiment of the present invention.

FIG. 6 shows a plurality of views of an amusement attraction 600 including a harnessed section 602 utilizing a continuous safety or belay system, as discussed in greater detail herein, which allows a user to slide along a zipline located at an elevation above a floor or lower surface of the amusement attraction 600. The user travels along the zipline from one portion of the amusement attraction 600 to another portion (e.g., at a fast rate of speed). In the harnessed section 602, users are coupled (e.g., via a rope and/or track coupling element) 604 to the amusement attraction 600 for safety purposes. As discussed in greater detail herein, the continuous safety or belay system may allow users to traverse among multiple pathways, at the users' discretion, without requiring the users to unhook and/or rehook to the safety or belay system. Although FIG. 6 illustrates one potential setup or design for the amusement attraction 600 that includes the harnessed section 602, in an alternative embodiment, any of a variety of possible setups or designs may be used.

Figure 7:
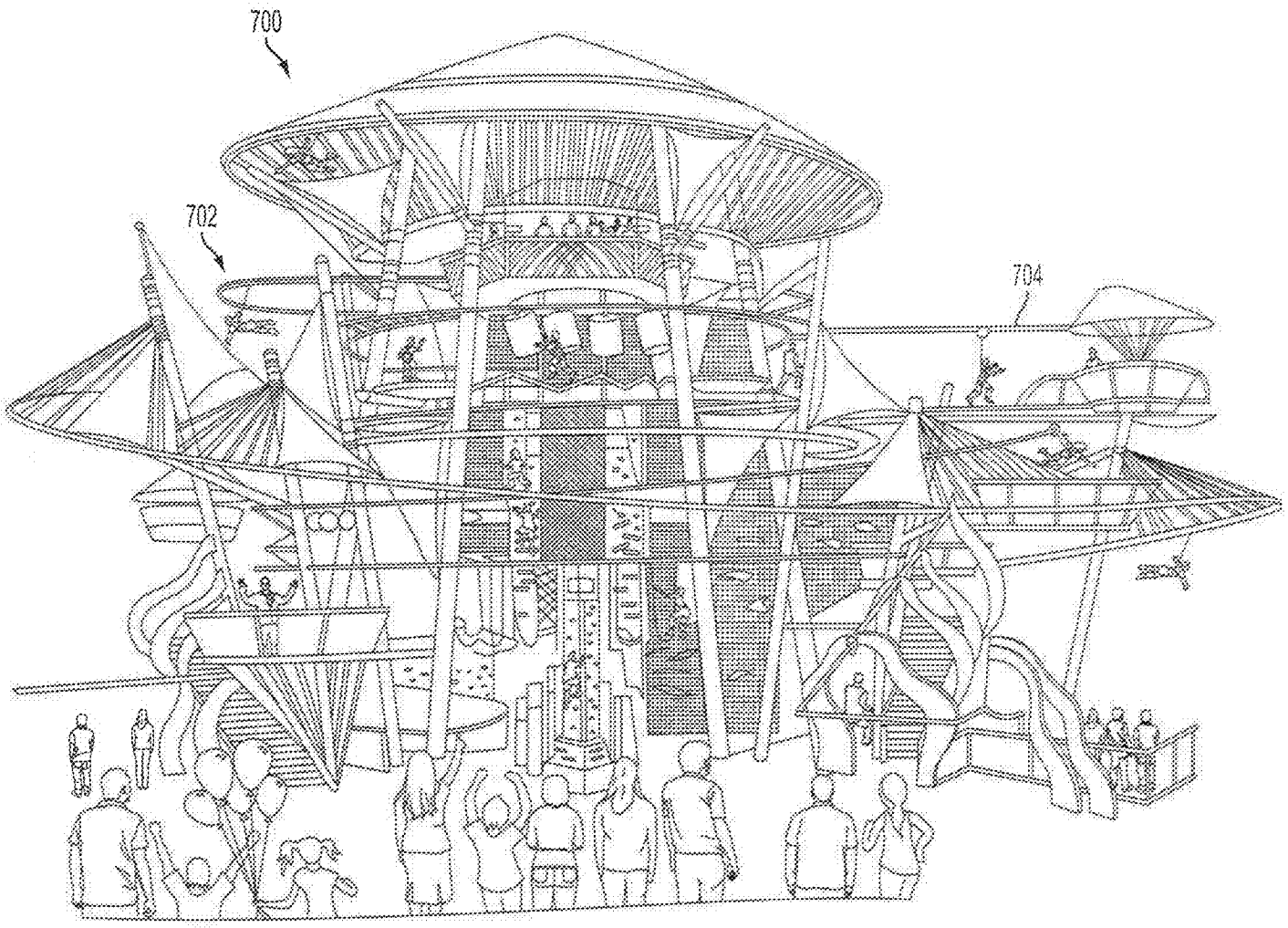
FIG. 7 shows an amusement attraction including a harnessed section and utilizing a continuous safety or belay system according to one embodiment of the present invention.

FIG. 7 shows a plurality of views of an amusement attraction 700 including a harnessed section 702 utilizing a continuous safety or belay system, as discussed in greater detail herein, which allows a user to climb, slide, or otherwise interact with a variety of differing features or activities of the amusement attraction 700. In the harnessed section 702, users are coupled (e.g., via a rope and/or track coupling element) to the amusement attraction 700 for safety purposes. As discussed in greater detail herein, the continuous safety or belay system may allow users to traverse among multiple pathways, at the users' discretion, without requiring the users to unhook and/or rehook to the safety or belay system. The amusement attraction 700 may be configured to have a cylindrical shape, wherein users can traverse the harnessed section 702 by circling around the perimeter of the amusement attraction and following branching, harnessed paths 704 to other activities or play areas. Although FIG. 7 illustrates one potential setup or design for the amusement attraction 700 that includes the harnessed section 702, in an alternative embodiment, any of a variety of possible setups or designs may be used.

In certain embodiments, any of the above described features for FIGS. 1-7 (e.g., leaping, traversing, ziplines, etc.) may be incorporated into any of a variety of designs for a desired amusement attraction. Utilizing the continuous safety or belay system, as described in greater detail herein, a user may participate in any and/or all of the features or activities of a given amusement attraction without needing to disconnect or reconnect to the safety or belay system. Thus, users are provided additional freedom to safely traverse an amusement attraction as they desire without being inconvenienced by the design of the safety systems during their traversal of the ride.

Figure 8:
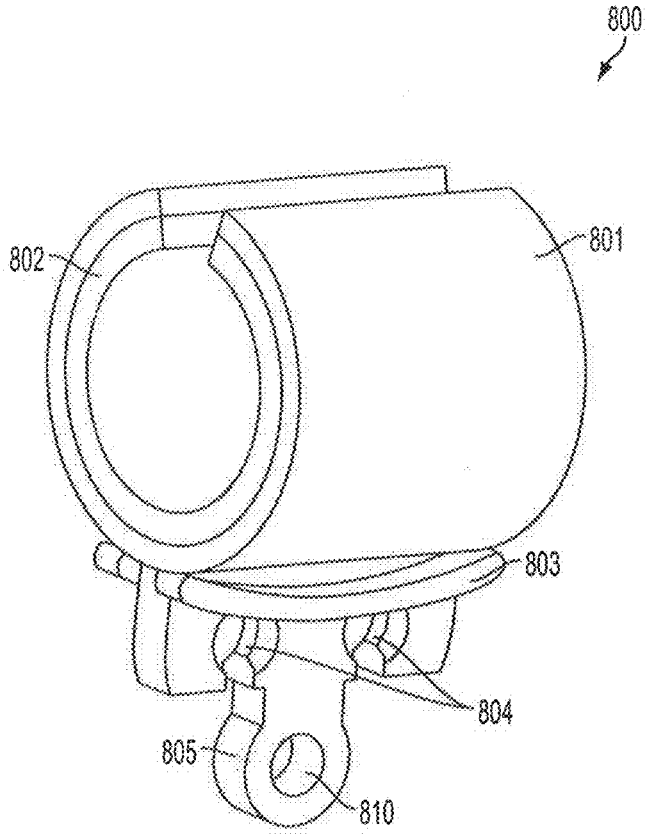
FIG. 8 shows a perspective view of a sliding safety mechanism according to one embodiment of the present invention.

Turning next to FIG. 8, an isometric view of a sliding safety mechanism 800 is shown according to one embodiment of the present invention. The sliding safety mechanism 800 includes a body 801 coupled with a low friction sleeve 802 (e.g., a polymer). The sleeve 802 permits sliding motion of the safety mechanism 800 along a track with reduced friction or wear. A support plate 803 is coupled with the body 801 and provides a surface or component for cooperating with one or more surfaces or components of a junction box or other transitioning structure that is used for transitioning between tracks as desired by the user, for example, as discussed in greater detail herein in FIGS. 11A-11D. An anchor ring 805 that defines an opening 810 is connected with the body 801, for example, via the support plate 803. The opening 810 of the anchor ring 805 permits a user to connect with the safety mechanism 800, for example via a clip and/or rope that also is held, fastened, or otherwise worn by or coupled with the user. A plurality of track keyholes 804 (e.g., in the support plate 803 or in a component connected with the support plate 803) permit the transition from one track to another, as discussed in greater detail below, for example in FIGS. 11A-1 ID, through the use of a junction box or assembly.

Figure 9A:
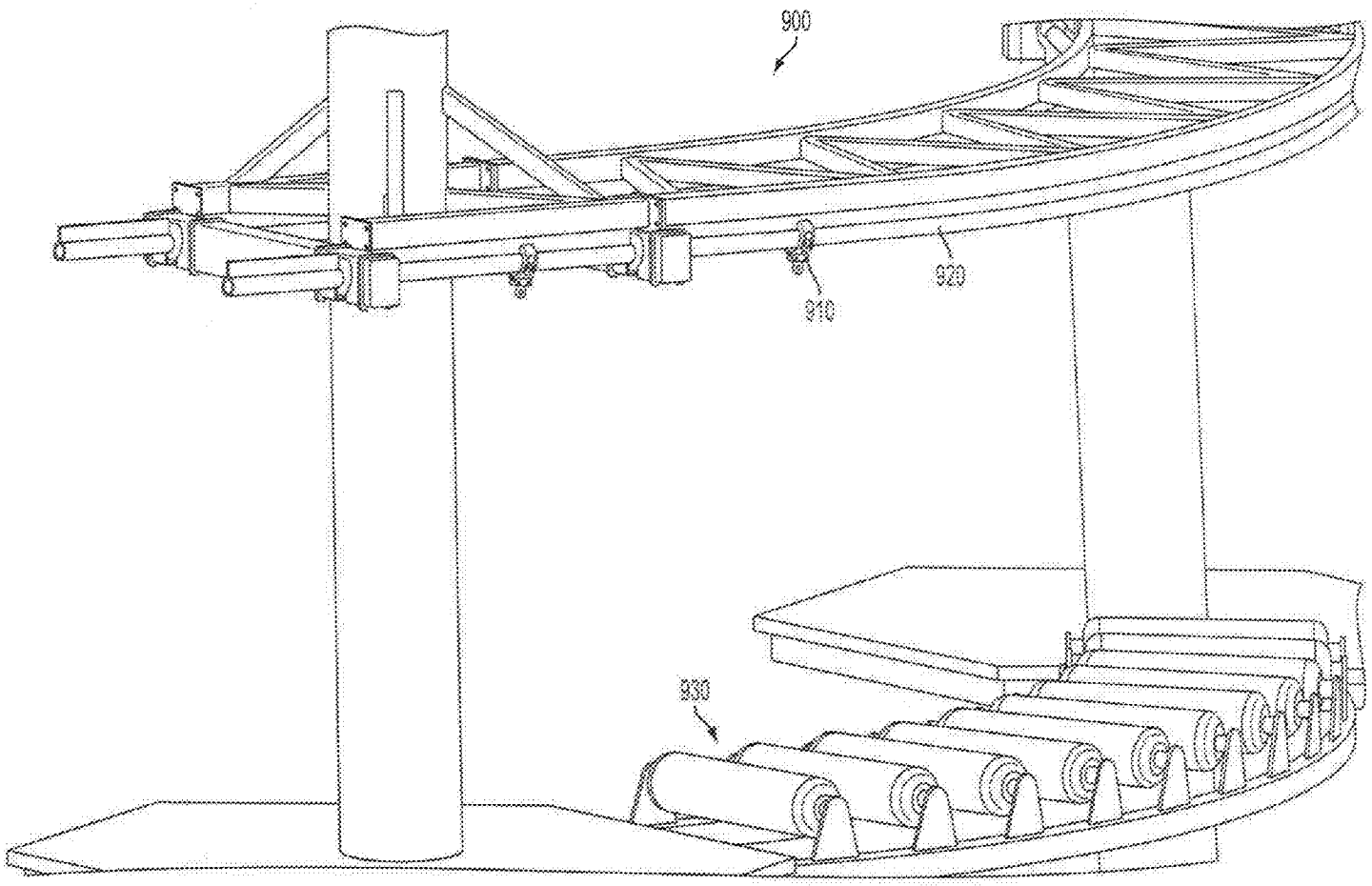
FIG. 9A shows a perspective view of a track of an amusement attraction using a sliding safety mechanism according to one embodiment of the present invention.
Figure 9B:
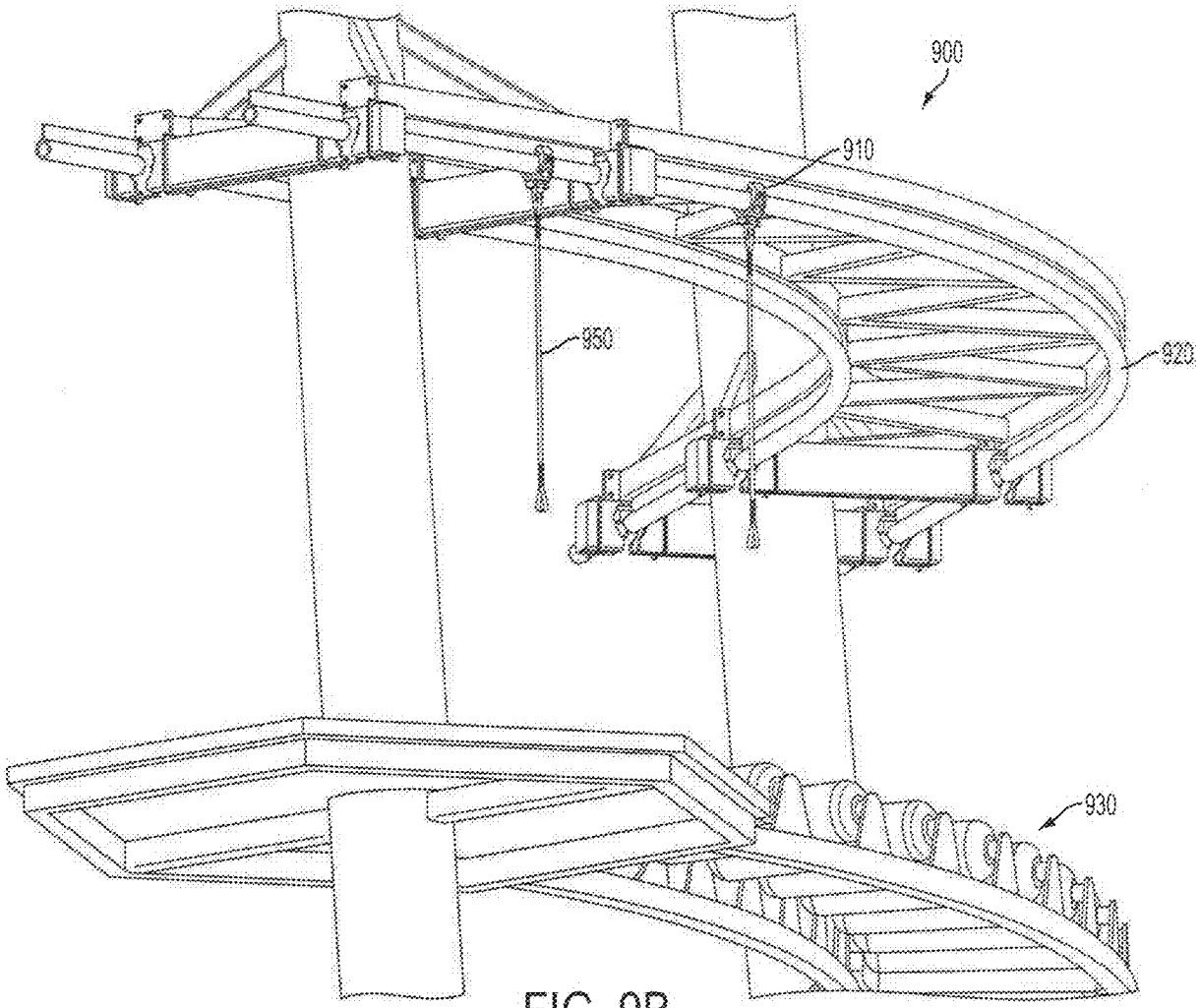
FIG. 9B shows a perspective view of the track of the amusement attraction using the sliding safety mechanism of FIG. 9A with an attached lanyard according to one embodiment of the present invention.

FIG. 9A shows a perspective view of a harnessed section 900 of an amusement attraction or other play structure using a sliding safety mechanism 910. FIG. 9B shows a perspective view of the harnessed section 900 of the amusement attraction using the sliding safety mechanism 910 of FIG. 9A with an attached lanyard 950. With reference to FIGS. 9A and 9B, a user or participant of the harnessed section 900 of the amusement attraction may wear a belt, vest, or other harness that is configured to couple with the lanyard 950 such that the user may traverse on obstacles 930 (e.g., a rope bridge, roller wheels, etc.) while safely connected to a track 920 (e.g., a tubular element) upon which the sliding safety mechanism 910 may slide along (e.g., the track 920 may be configured to be all or partially encompassed by a low friction surface of the sliding safety mechanism 910, for example, the low friction sleeve 802 of FIG. 8). In another embodiment, the track 920 may be any of a variety of shapes or configurations so long as it is permitted to cooperate with the sliding safety mechanism to slide therealong. If the user loses their footing, instead of falling off of the obstacles 930, the sliding safety mechanism 910 and track 920 keep the user from dropping a significant elevation to a lower floor or level, lessening the risk of injury.

Figures 9C, 9D:
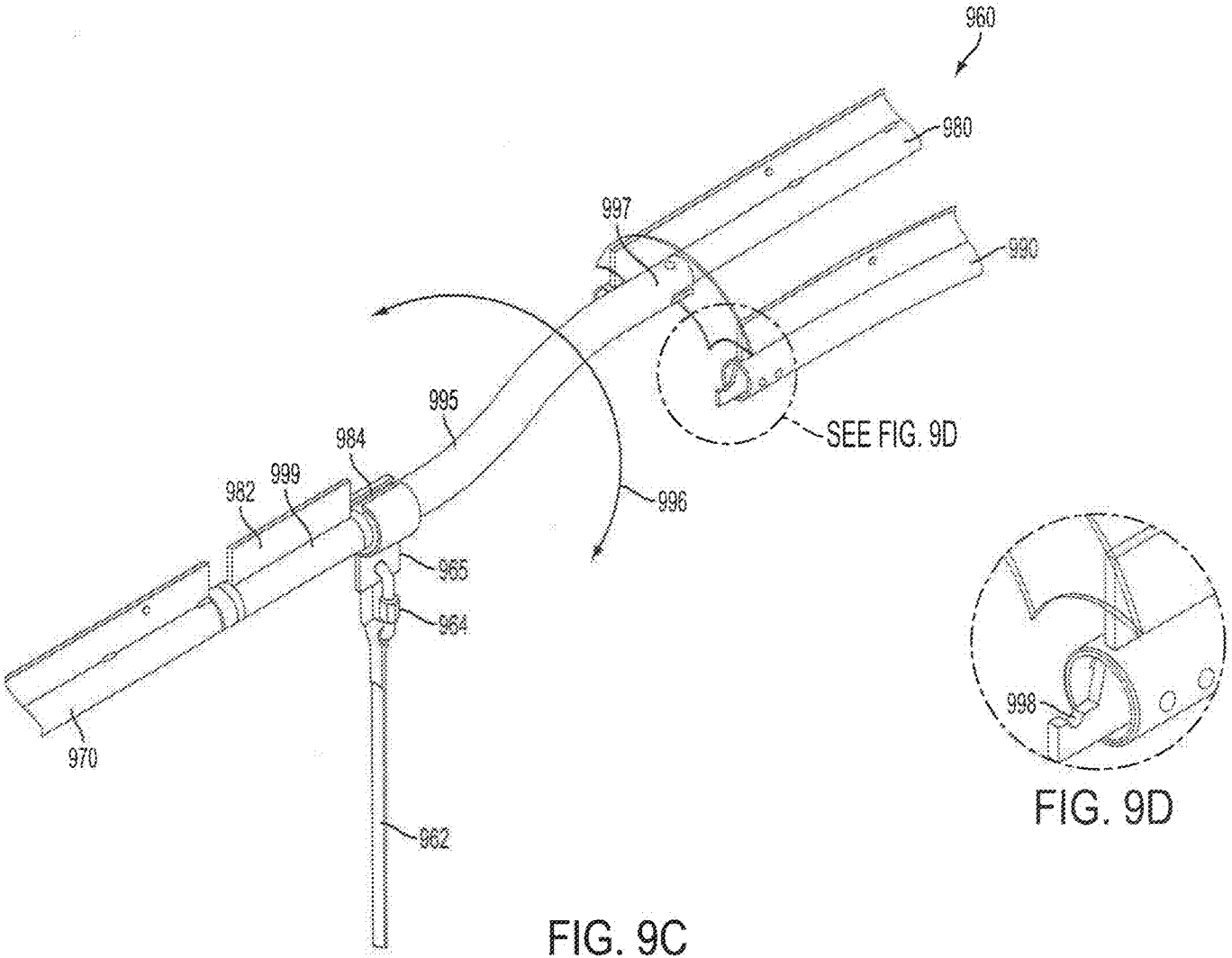
FIG. 9C shows a perspective view of a pivoting track of an amusement attraction using a sliding safety mechanism according to one embodiment of the present invention.
FIG. 9D shows a zoomed-in perspective view of a portion of the pivoting track of an amusement attraction using a sliding safety mechanism of FIG. 9C according to one embodiment of the present invention.

FIG. 9C shows a perspective view of a pivoting track system 960 of an amusement attraction that uses a sliding safety mechanism 965. Aspects of the track system 960 and/or the sliding safety mechanism 965 may be the same as or similar to those previously discussed. A user may be connected, for example via a rope or lanyard 962 that connects with a portion of the sliding safety mechanism 965 via a clamp or other connecting element 964. The pivoting track system 960 allows a user to travel along an entrance track 970 via sliding of the sliding safety mechanism 965 and then may choose whether to continue movement along a first exit track 980 or a second exit track 990 via a pivoting portion 995 that is configured to pivot, swivel, twist, or otherwise transfer 996 between the first exit track 980 and the second exit track 990.

In an alternative embodiment, greater numbers of exit tracks may be pivoted between by the pivoting portion 995 and/or alternative methods of moving between exit tracks may be used. The pivoting portion 995 may be moved into position manually by the user as the user travels along the entrance track 970 and/or by staff of the amusement attraction and/or via an electronic system controlled by the user and/or by staff of the amusement attraction. A key notch 998 may be disposed on one or more of the first exit track 980 and/or second exit track 990 that is configured to engage with a protruding element of a connecting end 997 of the pivoting portion 995 in order to facilitate a more secure connection. Bearing supports 999 may be used to provide additional stability or support for the rotating elements of or adjacent to the pivoting portion 995. In certain embodiments, one or more keying walls 982 may be installed along all or a portion of the entrance track 970, first exit track 980, and/or second exit track 990 and cooperate with a notch 984 in the sliding safety mechanism 965 in order to orient the sliding safety mechanism in a desired position (e.g., connecting element 964 downward) as it slides along a track.

Figure 10A:
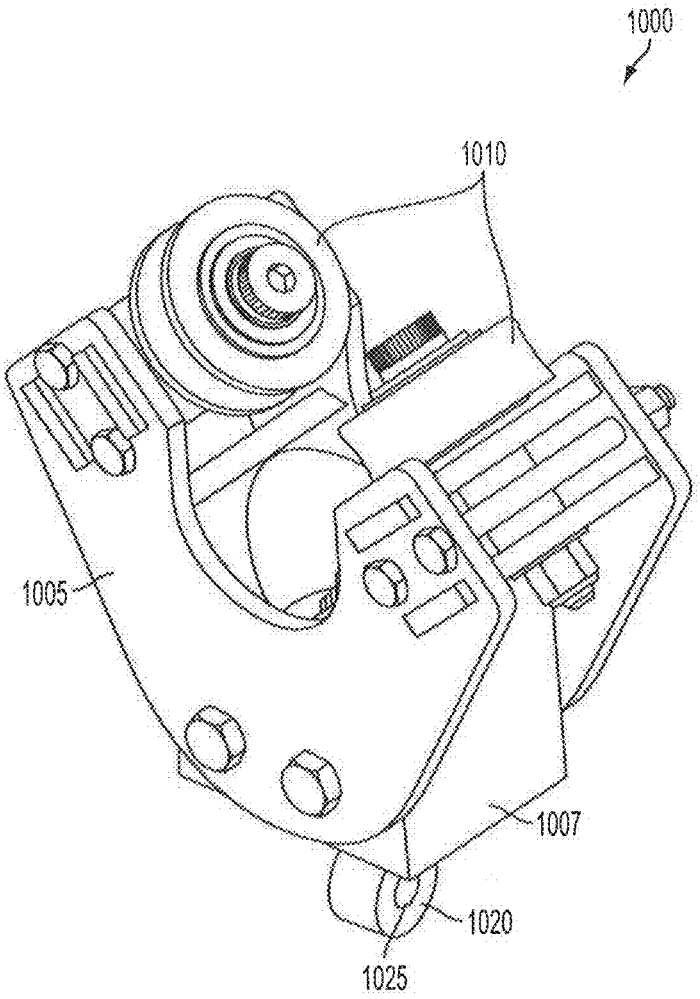
FIG. 10A shows a perspective view of a rolling safety mechanism according to one embodiment of the present invention.
Figure 10B:
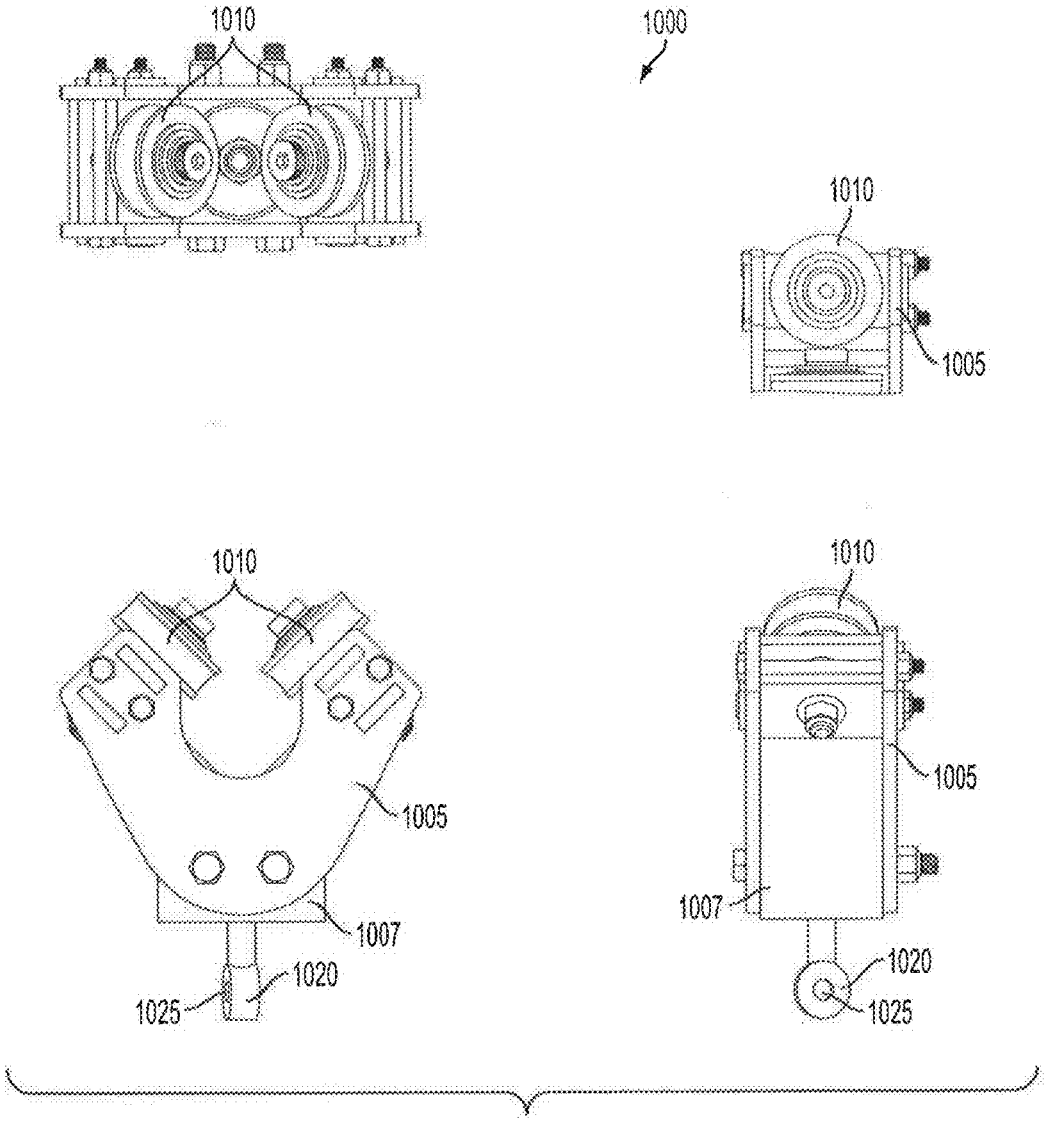
FIG. 10B shows a plurality of views of the rolling safety mechanism of FIG. 10A according to one embodiment of the present invention.

FIGS. 10A and 10B show various views of a rolling safety mechanism 1000. The rolling safety mechanism 1000 may include features or operate in a manner that is the same as or similar to those previously discussed. For example, instead of sliding along a track (e.g., see the sliding safety mechanism 800 of FIG. 8), the rolling safety mechanism 1000 may incorporate one or more rollers 1010 that are configured to rotate or roll along an exterior of a track (see, for example, FIG. 12). In another embodiment, one or more ball-bearings or spherical style rollers may be used. Other aspects of the rolling safety mechanism may be the same as or similar to those safety systems previously discussed (e.g., the rolling safety mechanism 1000 may include a body component 1005 and a connecting plate 1007 that is coupled with an anchor ring 1020 defining an opening 1025 therein for a user to connect to the rolling safety mechanism 1000 via a rope, lanyard, etc.).

FIGS. 11A-11D show various views of one embodiment of a junction box 1100 that allows a user to transition from a first track to a second track in an amusement attraction without requiring the user to unhook from and/or rehook to a safety or belay system in conjunction with the transition. In one example, the junction box 1100 may be configured to operate with a sliding safety system, such as the sliding safety system 800 previously described for FIG. 8. Certain features of the junction box 1100 may also be used in an alternative embodiment that works with other safety system designs (e.g., the rolling safety system 1000 previously discussed). The junction box 1100 and any associated sliding safety system may include features that are the same as or similar to those previously discussed.

Figure 11A:
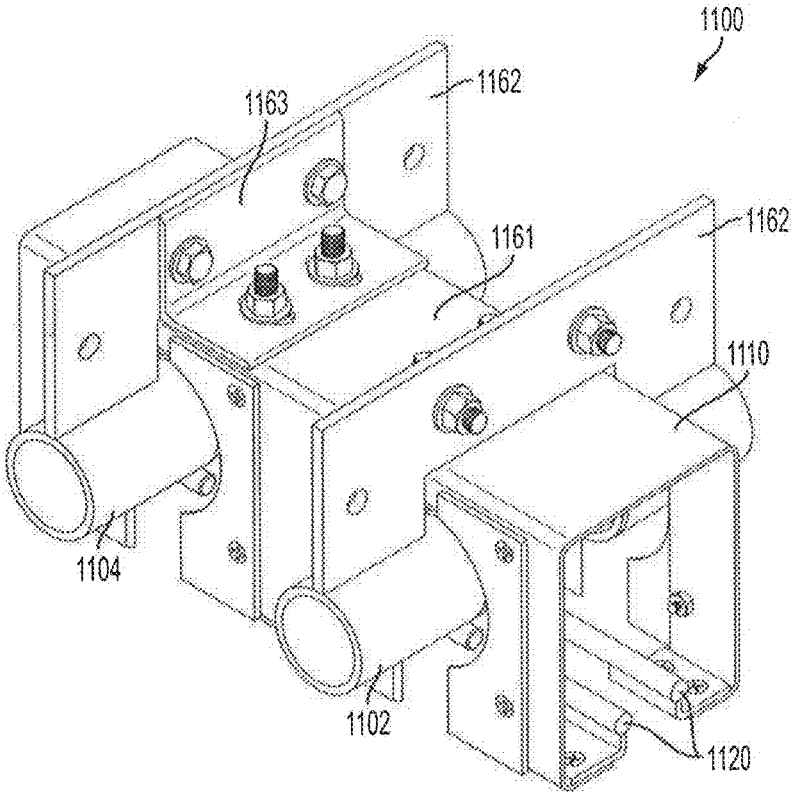
FIG. 11A shows a perspective view of a junction box for use with a sliding safety or belay mechanism according to one embodiment of the present invention.
Figure 11B:
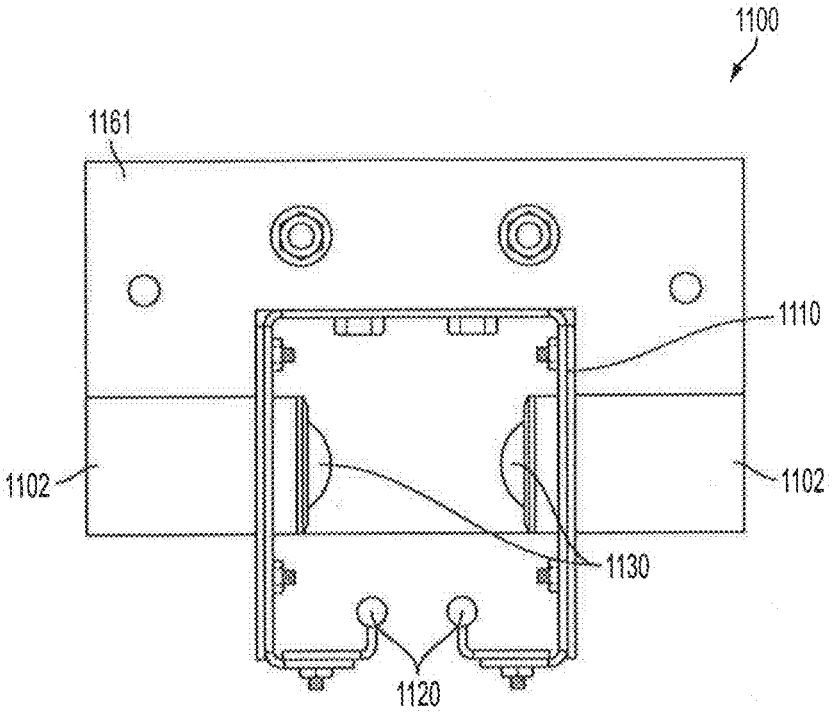
FIG. 11B shows a side view of the junction box of FIG. 11A according to one embodiment of the present invention.
Figure 11C:
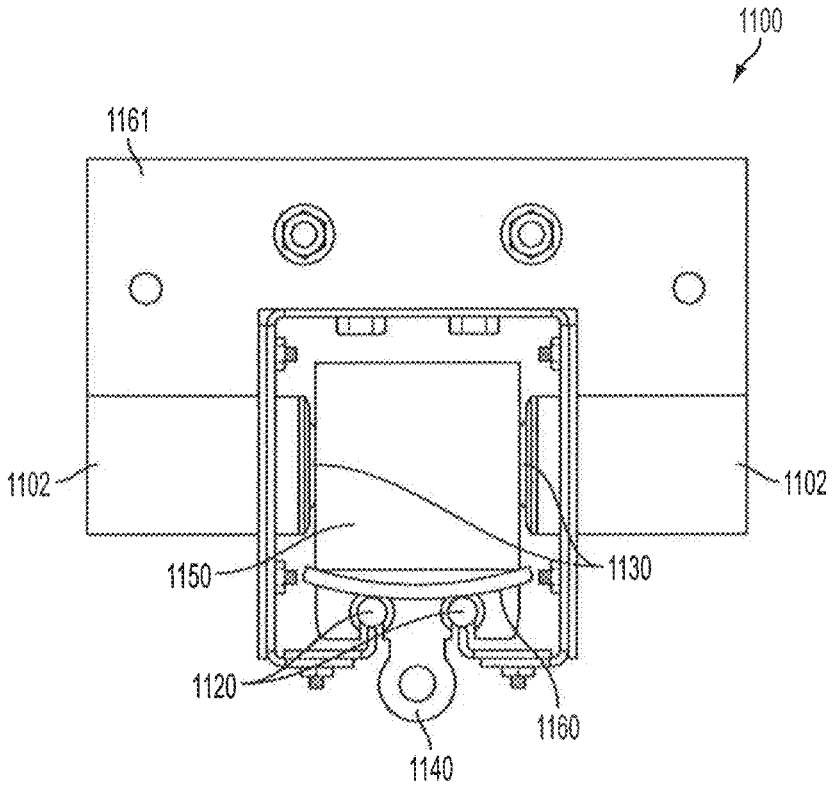
FIG. 11C shows a side view of the junction box of FIG. 11A with an included safety or belay mechanism within according to one embodiment of the present invention.

Particularly, FIG. 11A shows a perspective view of the junction box 1100. FIG. 11B shows a side view of the junction box 1100 without a safety or belay mechanism contained therein while FIG. 11C shows a side view of the junction box 1100 with a safety or belay mechanism contained therein. A first track 1102 may be disposed such that a user sliding therealong can travel to a first activity or feature of an amusement attraction that lies along or is contiguous with the first track 1102 and a second track 1104 may be disposed such that a user sliding therealong can travel to a second activity or feature of the amusement attraction that lies along or is contiguous with the second track 1104.

A user that is sliding along the first track 1102 via a sliding safety system (e.g., the sliding safety system 800 of FIG. 2) may wish to transfer from the first track 1102 to the second track 1104 in order to travel to the second activity or feature. In a conventional safety or belay system this would not be possible unless the second activity or feature was already located at a position along the first track 1102 and/or would require the user to disconnect from the safety system and/or the first track 1102 and reconnect to the safety system and/or the second track 1104.

As shown in FIG. 11A, however, the junction box 1100 operates to permit the user connected with the sliding safety system to interface with one or more lateral support tracks 1120 that extend at an angle (e.g. perpendicular, as illustrated) to the first track 1102 and/or the second track 1104. In an alternative embodiment, any of a variety of angles to the first track 1102 and/or the second track 1104 may be possible for disposition of the one or more lateral support tracks 1120. In this manner, keyholes in the sliding safety system (e.g., keyholes 804 as shown in FIG. 8) may cooperate with the one or more lateral support tracks 1120 to allow the user to transition from the first track 1102 to the second track 1104, or vice versa, without having to perform any disconnections from the sliding safety system.

For example, when the lateral support tracks 1120 are disposed within the keyholes 804, the support plate 803 may rest and therefore slide on top of the lateral support tracks 1120 to the desired main track. In one embodiment, a low-friction surface (e.g., a coating or mechanical component, such as ball bearings) may be disposed upon a lower surface of the support plate 803 to accommodate lower friction sliding on top of the lateral support tracks 1120. After traversing along the lateral support tracks 1120 to a desired main track (e.g., the first track 1102 or the second track 1104), the user may engage with such track and continue along its pathway (e.g., via a low-friction sleeve, such as sleeve 802, that encompasses all or a portion of the track, as seen in FIG. 8). The junction box 1100 may have a body component 1161 (e.g., composed of various pieces welded, screwed, bolted, or otherwise fastened together) in order to align the various main tracks and/or support tracks in a desired orientation. One or more track mounts 1162 with one or more track mount support brackets 1163 may connect the body 1161 of the junction box 1100 with a desired track or portion of the amusement attraction.

Figure 11D:
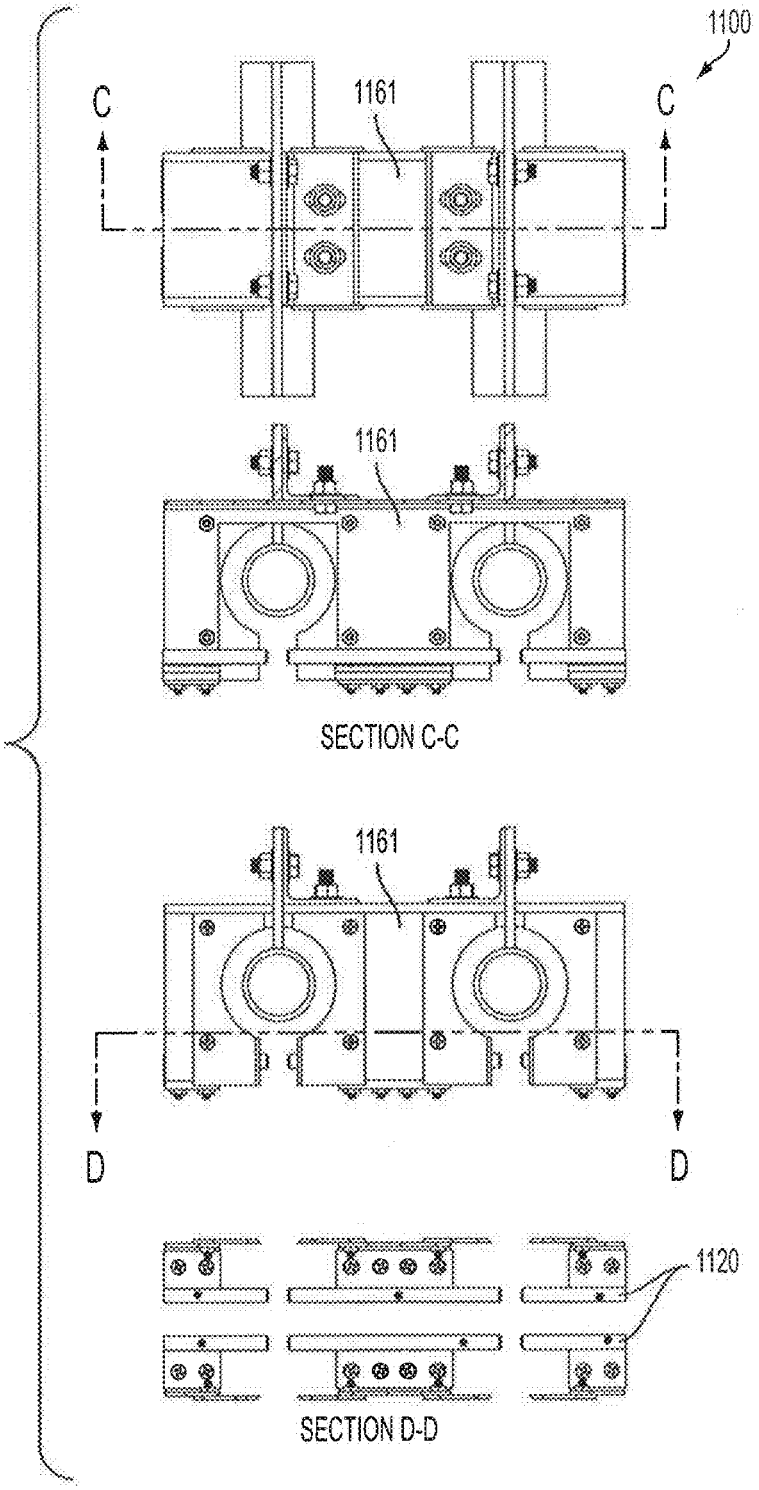
FIG. 11D shows a plurality of views of the junction box of FIG. 11A according to one embodiment of the present invention.

With reference to FIGS. 11B-11D, in one example, operation allows a participant to navigate an aerial challenge course. The participant is secured in a harness (e.g., a full-body harness) that is attached with a lanyard to a sliding belay mechanism 1150 (see FIG. 11C), such as the sliding safety system 800 of FIG. 8, via an anchor ring 1140 (see FIG. 11C), such as the anchor ring 805 of FIG. 8. The sliding belay mechanism 1150 slides along a track (e.g., horizontal or nearly horizontal), that may be manufactured of round tubing, above or through various challenge elements of the amusement course. In one embodiment, the track may feature curves and/or direction changes (e.g., with radiuses greater than 20 inches). The sliding belay mechanism 1150 can feature low-friction features (e.g., the low friction sleeve 802 of FIG. 8) or rolling elements (e.g., as discussed in FIG. 9) in order to secure and smoothly travel along the track. In one embodiment, the track may be supported directly above via a welded full-length section of vertically oriented flatbar that is bolted to supporting structures. In such an embodiment, the sliding belay mechanism 1150 may feature a gap in order to clear this flatbar when traveling adjacent to it along the track.

The participant is allowed to safely transition between one or more (e.g., parallel) tracks, such as the first track 1102 and the second track 1104, while under continuous, passive belay at the junction box 1100. As the sliding belay mechanism 1150 enters the junction box 1100, one or more curved support plates 1160 (e.g., support plate 803 of FIG. 8) engages on the top of the lateral support tracks 1120 as the sliding belay mechanism 1150 travels through a gap between the lateral support tracks 1120 to the centerline of the junction box 1100. As the sliding belay mechanism 1150 enters the centerline of the junction box 1100, it leaves the track and is supported by the one or more support plates 1160. A clamp is positioned by sprung detent ball plugs 1130 (see FIG. 11B) to help prevent twisting.

Once at the centerline of the junction box 1100, the keyholes (e.g., keyholes 804 as shown in FIG. 8) in the sliding belay mechanism 1150 line up with the lateral support tracks 1120 and the sliding belay mechanism 1150 can now travel along the pathway defined by the lateral support tracks 1120 (e.g., perpendicular to the main track) under passive, continuous belay. Once at the centerline of the intended track (e.g., the first track 1102 and/or the second track 1104), the sliding belay mechanism 1150 is positioned using the spring detent ball plugs 1130. The sliding belay mechanism 1150 can now exit the junction box 1100 through a gap in the lateral belay tracks 1120.

Figure 11E:
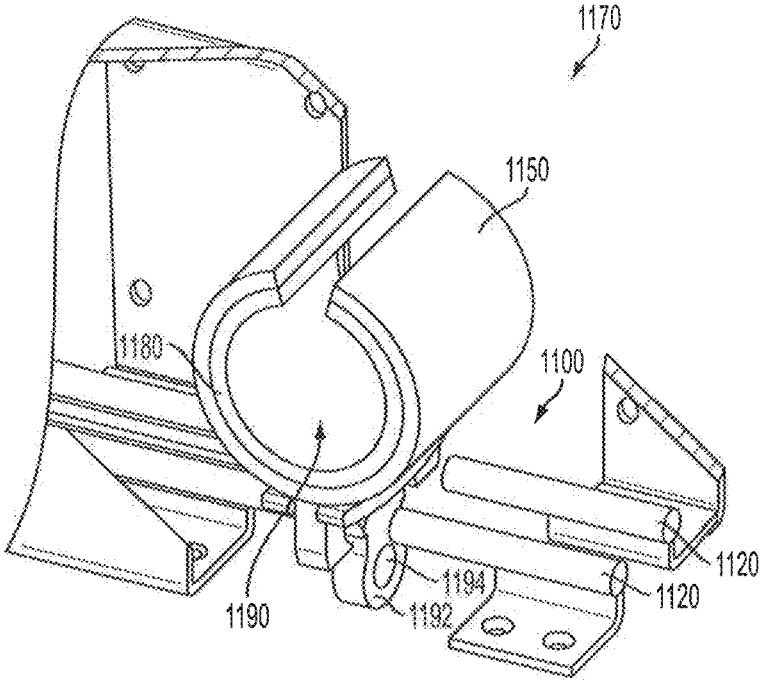
FIG. 11E shows a perspective view of the operation of a safety or belay system with the junction box of FIG. 11A according to one embodiment of the present invention.

FIG. 11E shows a perspective cut-away view of the use or operation 1170 of the safety or belay mechanism 1150 with a junction box 1100. The safety or belay mechanism 1150 may include features, uses, and/or operation that are the same as or similar to those previously discussed, for example, the sliding safety mechanism 800 of FIG. 8. As illustrated, and with reference to the above discussion for FIGS. 11A-11D, the safety or belay mechanism 1150 includes a sleeve 1180 defining an opening 1190 that is configured to slide along a track (e.g., a tubular element or a desired radius). An anchor ring 1192 defines an opening 1194 therein, the opening 1194 configured to cooperate with a clip or other fastening mechanism that is coupled with a lanyard. A user may be connected with an opposing end of the lanyard. When within the junction box 1100, the safety or belay mechanism 1150 slides along one or more lateral support tracks 1120 in order to transition between main track components. Once the safety or belay mechanism 1150 is lined up with a main track component, the safety or belay mechanism is configured to mate with the main track component via the opening 1190 of the sleeve 1180 and travel on the main track component, disengaged from the lateral support tracks 1120.

Figure 12:
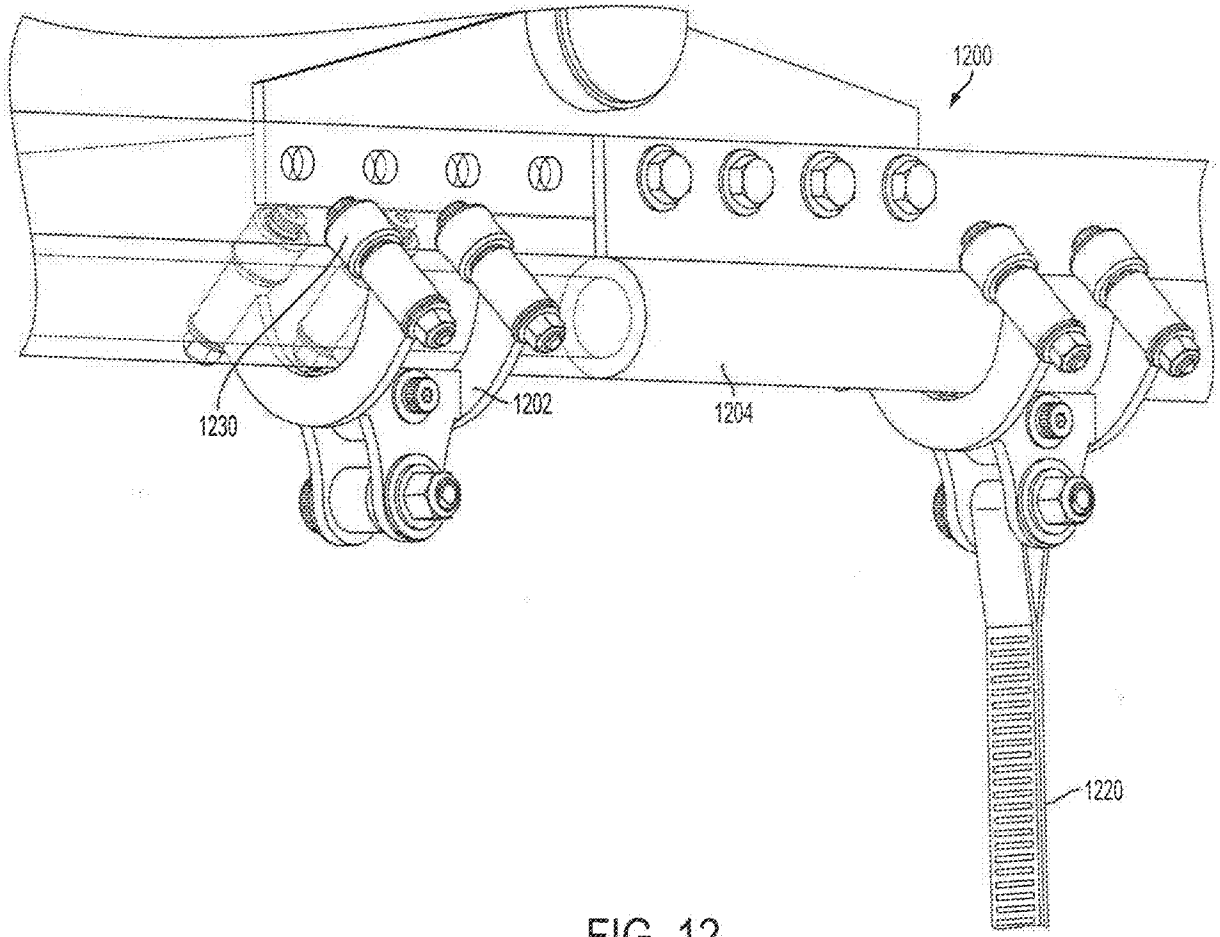
FIG. 12 shows a perspective view of a rolling safety mechanism on a track according to one embodiment of the present invention.
Figure 13C:
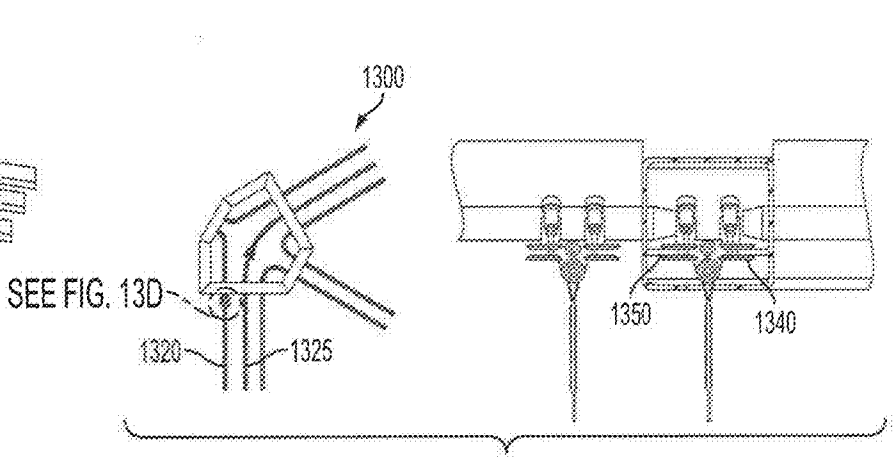
FIG. 13C shows a plurality of top views of the rolling safety mechanism and the associated junction box of FIG. 13A according to one embodiment of the present invention.
Figure 13D:
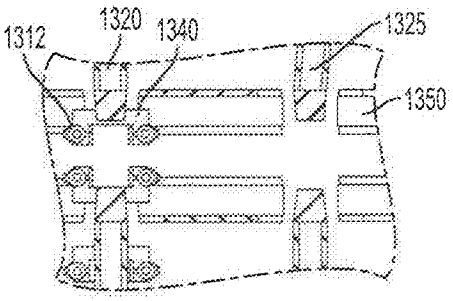
FIG. 13D shows a zoomed-in cutaway top view of the rolling safety mechanism and the associated junction box of FIG. 13A according to one embodiment of the present invention.
Figure 13A:
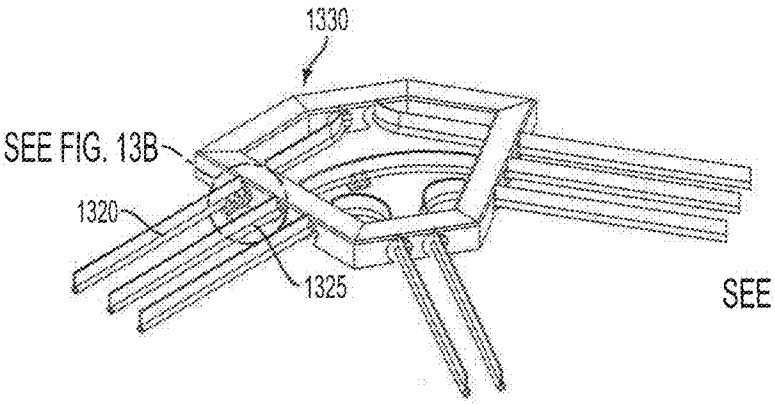
FIG. 13A shows a perspective view of a rolling safety mechanism and an associated junction box according to one embodiment of the present invention.
Figure 13B:
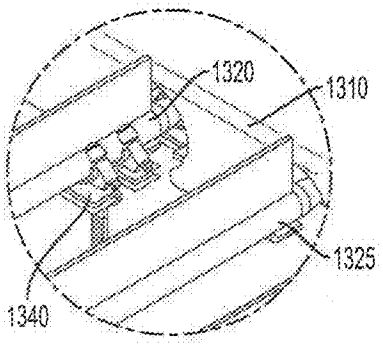
FIG. 13B shows a zoomed-in perspective view of the rolling safety mechanism and the associated junction box of FIG. 13A according to one embodiment of the present invention.

FIG. 12 shows a perspective view 1200 of a rolling safety mechanism 1202 on a tubular track 1204. The rolling safety mechanism 1202 and/or the tubular track 1204 may include features that are the same as or similar to those previously discussed. As shown, a plurality of rolling elements 1230 are configured to cooperate and roll along the track 1204 such that the rolling safety mechanism 1202 travels down the track 1204 with a user with reduced friction. Any of a number of rolling elements 1230 in a variety of configurations (e.g., ball bearings coupled with a surface that makes contact with an exterior of the track 1204) may be implemented in alternative embodiments. The user may be connected to the rolling safety mechanism 1202 by any of a variety of connection means, such as a lanyard 1220 with or without a connecting plate (e.g., which may allow the user to pivot via a pivoting connection and/or slide within the connecting plate (such as via a slot) or any of a variety of other connecting components (e.g., standardized components, off-the-shelf components, and/or a variety of other specific or specialized connecting components).

FIGS. 13A-D shows a plurality of views 1300 of a rolling safety mechanism 1310 (e.g., a trolley) configured to roll along one or more tracks (e.g., first track 1320 and second track 1325) and cooperate with a junction box 1330 in an amusement attraction. The rolling safety mechanism 1310, the first track 1320, and/or the junction box 1330 may include features that are the same as or similar to those previously discussed. As shown, the rolling safety mechanism 1310 includes a plurality of rolling elements that make rolling contact with the first track 1320 so that the rolling safety mechanism may travel along the first track 1320 with a user. Upon encountering the junction box 1330, a user connected with the rolling safety mechanism may choose among a plurality of tracks with which to connect.

In one embodiment, as shown, the rolling safety mechanism 1310 includes one or more support plates 1340 (e.g., indexing plates) that are configured to make contact with one or more translation rails 1350 that are positioned laterally or otherwise adjacent and/or between tracks of the amusement attraction in the junction box 1330. For example, if the rolling safety mechanism 1310 is traveling along the first track 1320 and, upon reaching the junction box 1330, the user decides to switch to the second track 1325, the user may cause the rolling safety mechanism 1310 to travel along the translation rails 1350 via sliding contact with the support plates 1340 until the rolling safety mechanism 1310 is lined up with the second track 1325. At this time, the user may cause the rolling safety mechanism 1310 to travel along the second track 1325 and the rolling safety mechanism 1310 no longer makes contact with any translation rails 1350 via the support plates 1340. In certain embodiments, friction may be lessened during the sliding contact of the support plates 1340 and the translation rails 1350 (e.g., ball bearings may be coupled or embedded with the support plates 1340 and/or translation rails 1350, low friction materials may be used or applied to the support plates 1340 and/or translation rails 1350, etc.).

Any of a variety of track shapes or configurations may be used in conjunction with the junction box to allow a user to choose a desired path for travel in the amusement attraction. For example, straight tracks may be used, or the tracks may be curved, for example, as shown. The user may choose to engage with any of a variety of tracks by traversing along the translation rails 1350 of the junction box 1330.

Figure 14:
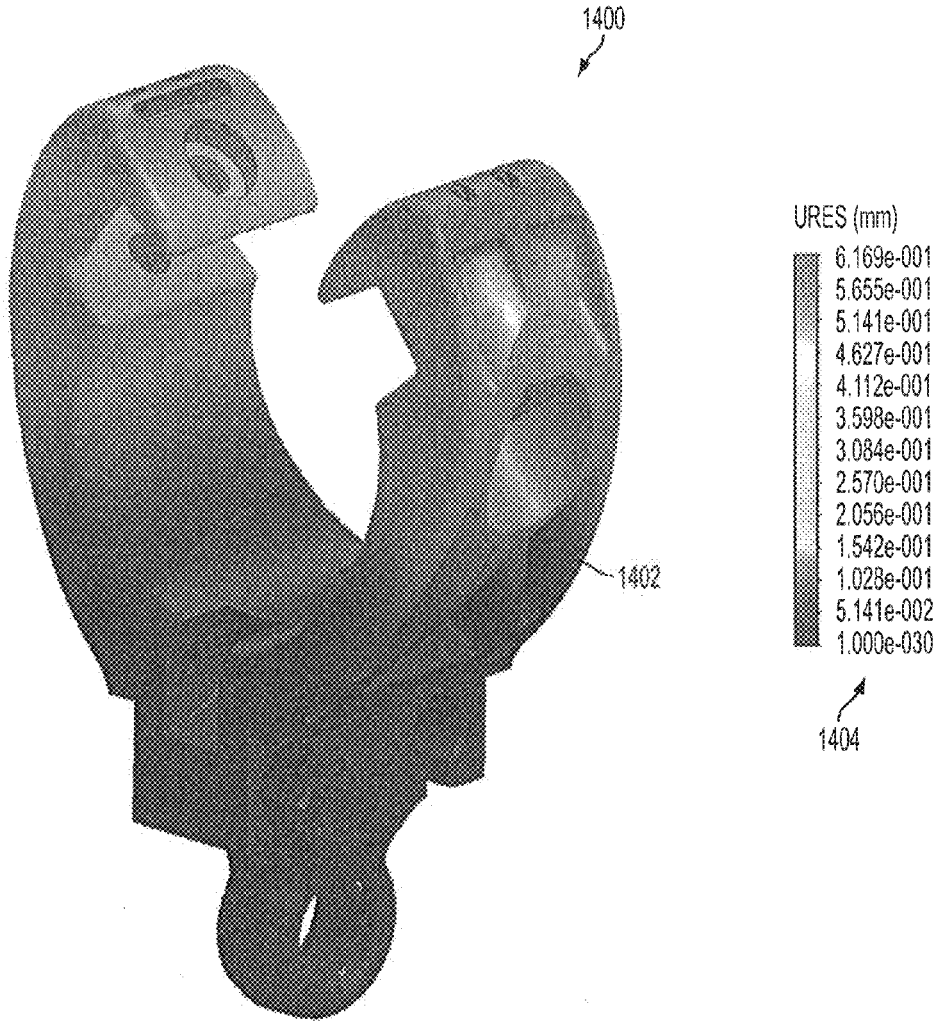
FIG. 14 shows a perspective view of a body for a rolling safety mechanism with corresponding URES displacement data according to one embodiment of the present invention.
Figure 15:
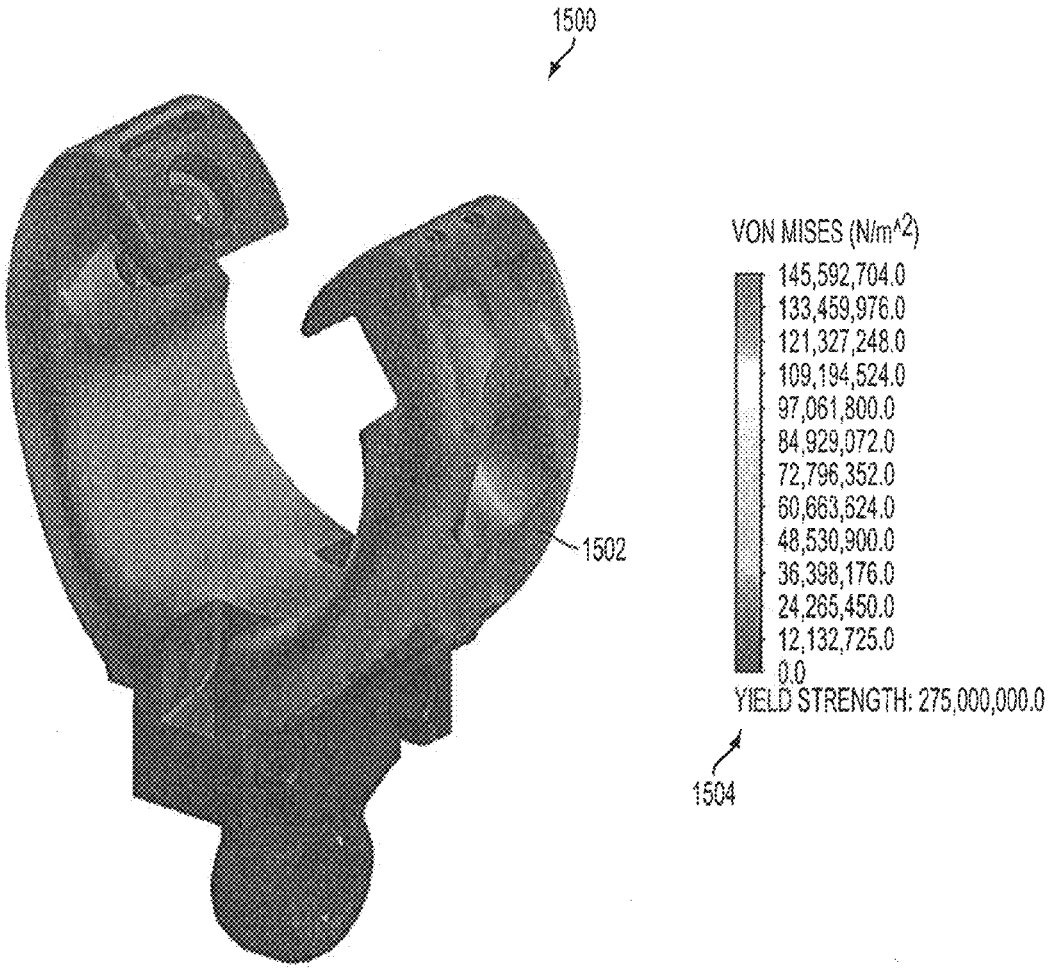
FIG. 15 shows a perspective view of a body for a rolling safety mechanism with corresponding static nodal stress data according to one embodiment of the present invention.

FIG. 14 shows a perspective view 1400 of a body 1402 for a rolling safety mechanism with corresponding URES displacement test data 1404. The body 1402 of the rolling safety mechanism may include features that are the same as or similar to those previously discussed. FIG. 15 shows a perspective view 1500 of a body 1502 for a rolling safety mechanism with corresponding static nodal stress test data 1504. The body 1502 of the rolling safety mechanism may include features that are the same as or similar to those previously discussed. Certain embodiments of rolling safety mechanisms utilizing URES data and/or stress data that complies with the same or similar values to these shown may provide certain desirable features (e.g., additional strength) for use in certain amusement attractions configurations.

Figure 16:
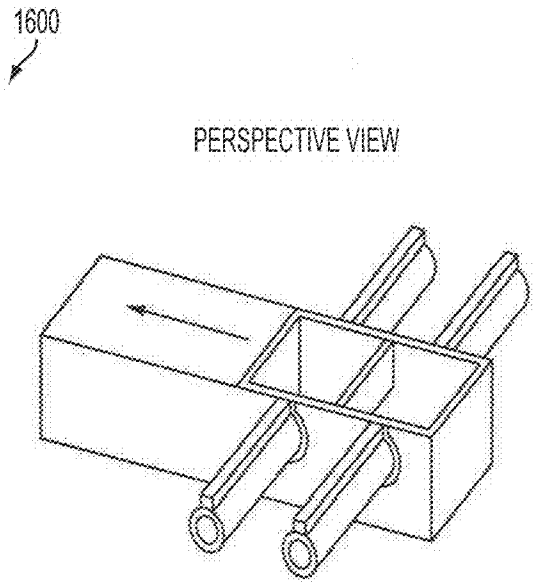
FIG. 16 shows a plurality of views of a passing lane configuration for use with a safety or belay mechanism according to one embodiment of the present invention.
Figure 16:
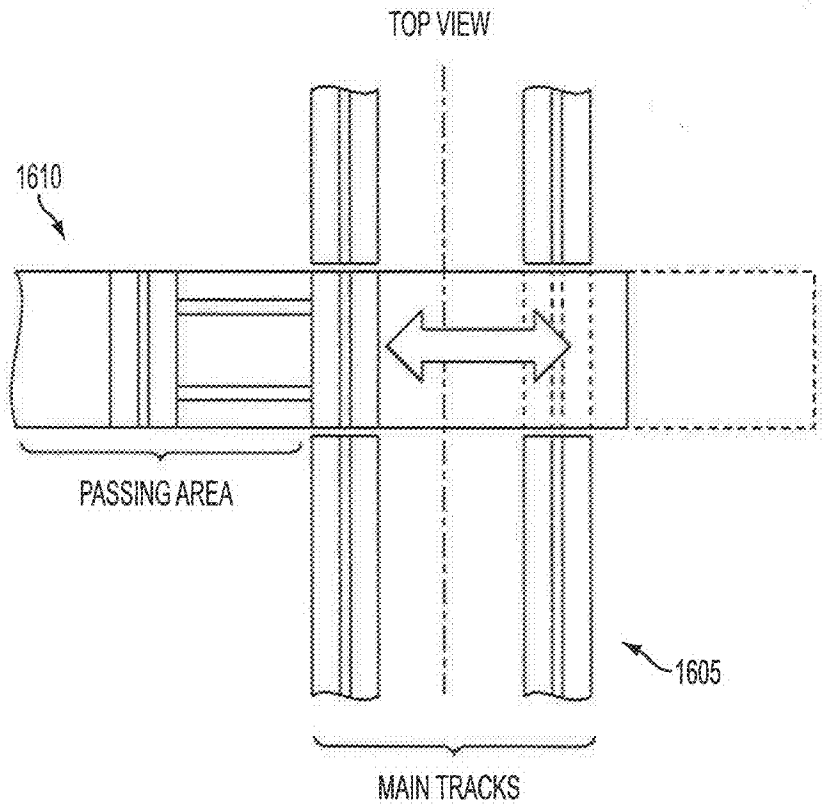

FIG. 16 shows a plurality of views of a passing box 1600 for use with a safety or belay mechanism. The passing box 1600 and/or the safety or belay mechanism may include features that are the same as or similar to those previously discussed. For example, the passing lane box may include features of the previously described junction boxes such that a user can opt to change to a different track without unhooking from a safety device while on an amusement attraction. In this manner, a user who is behind another user on a track 1605 of an amusement attraction need not wait for the user in front of them to finish their activity or more out of the way. Instead, the user in back may choose to pass the front user by switching to a parallel or other track. Alternatively, the passing box may allow for the user in front to transfer out of the way of a user behind them to a waiting track or space 1610 and wait for such user to pass before switching back to the original track 1605 and continuing with their activity. Such switching may be aided by gravity such that the user can begin movement towards the other track at a junction point and gravity will aid in securing the safety or belay mechanism to other track.

Figure 17:
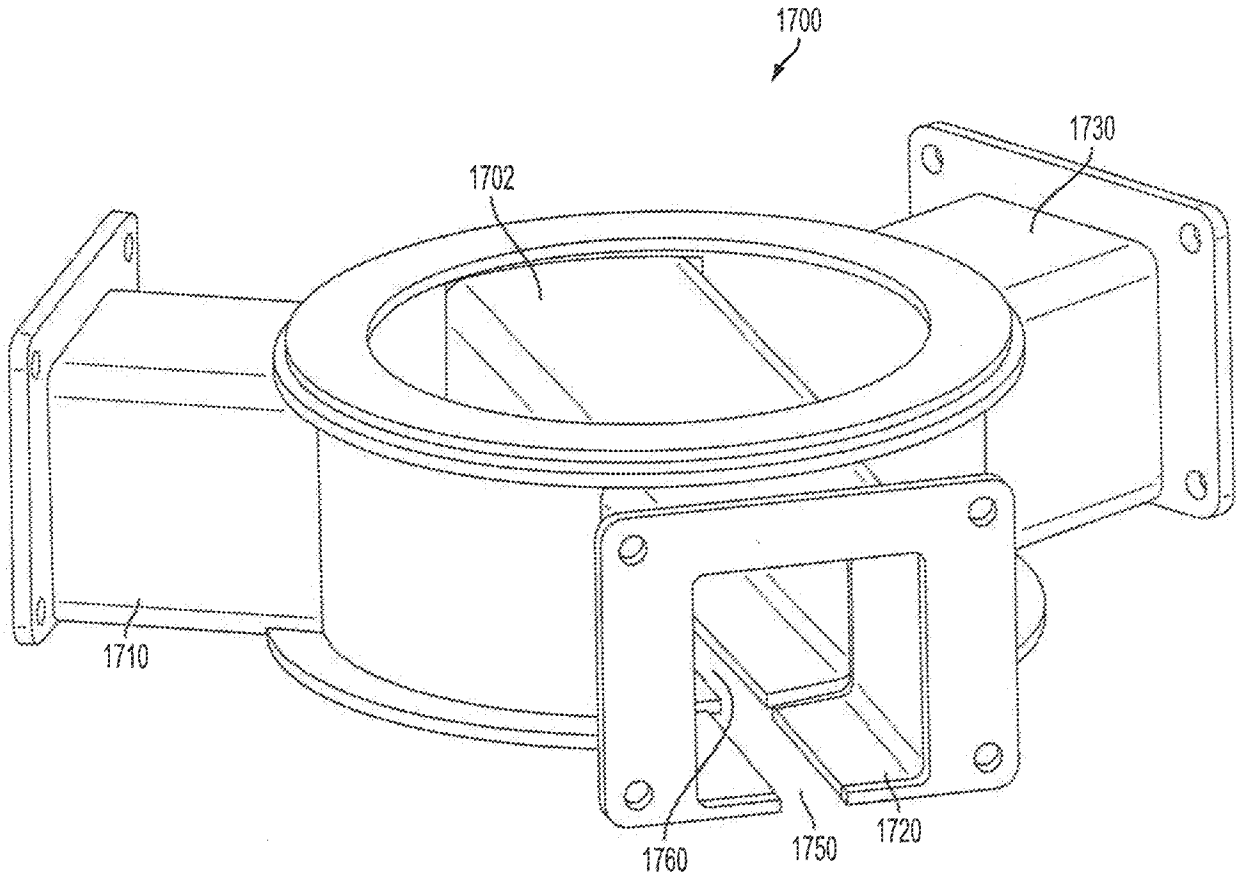
FIG. 17 shows a perspective view of a rotating junction box for use with a safety or belay mechanism according to one embodiment of the present invention.

FIG. 17 shows a perspective view of a rotating junction box 1700 for use with a safety or belay mechanism according to one embodiment of the present invention. The turntable box 1700 and/or the safety or belay mechanism may include features that are the same as or similar to those previously discussed. For example, the turntable box may include features of the previously described junction boxes or passing boxes such that a user can opt to change to a different track without unhooking from a safety device while on an amusement attraction. The turntable box 1700 may have a rotatable portion 1702 (e.g., in its center) such that a user connected with the safety or belay mechanism (e.g., that cooperates with a slot 1750 in a first track 1720 of the turntable box 1700) can slide along one the first track 1720, encounter the rotatable portion 1702 of the turntable box 1700, and then rotatably choose a new track (e.g., second track 1710 or third track 1730) to travel along.

Any of a number of possible new tracks may be selectable by the user or staff member for an amusement attraction in an alternative embodiment, either via manual rotation or electronic rotation). In one example, a user may slide along the first track 1720 and position the safety or belay mechanism into a slot 1760 in the rotatable portion 1702. The user may then manually rotate (e.g., via crank, a connected electronic system that is manipulatable via user control such as a button or switch, or via the user's own body movement or inertia), or the turntable will automatically rotate, the rotatable portion 1702 such that the slot 1760 of the rotatable portion 1702 lines up with a slot (not shown) of the second track 1710 or the third track 1730. The user may then continue travel along such chosen track.

Figure 18A:
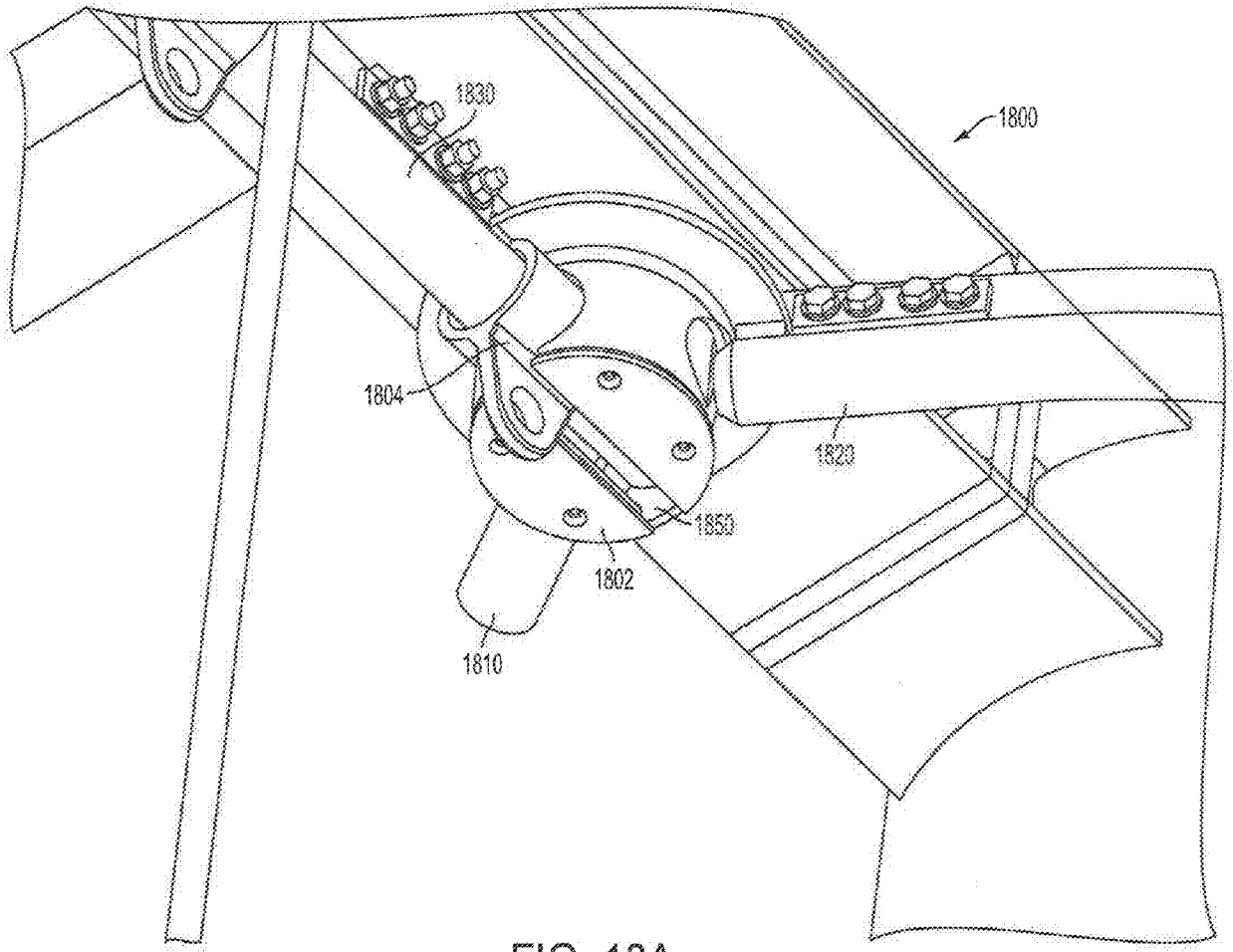
FIG. 18A shows a bottom perspective view of a slider clamp track with a rotatable component for use with a safety or belay mechanism according to one embodiment of the present invention.
Figure 18B:
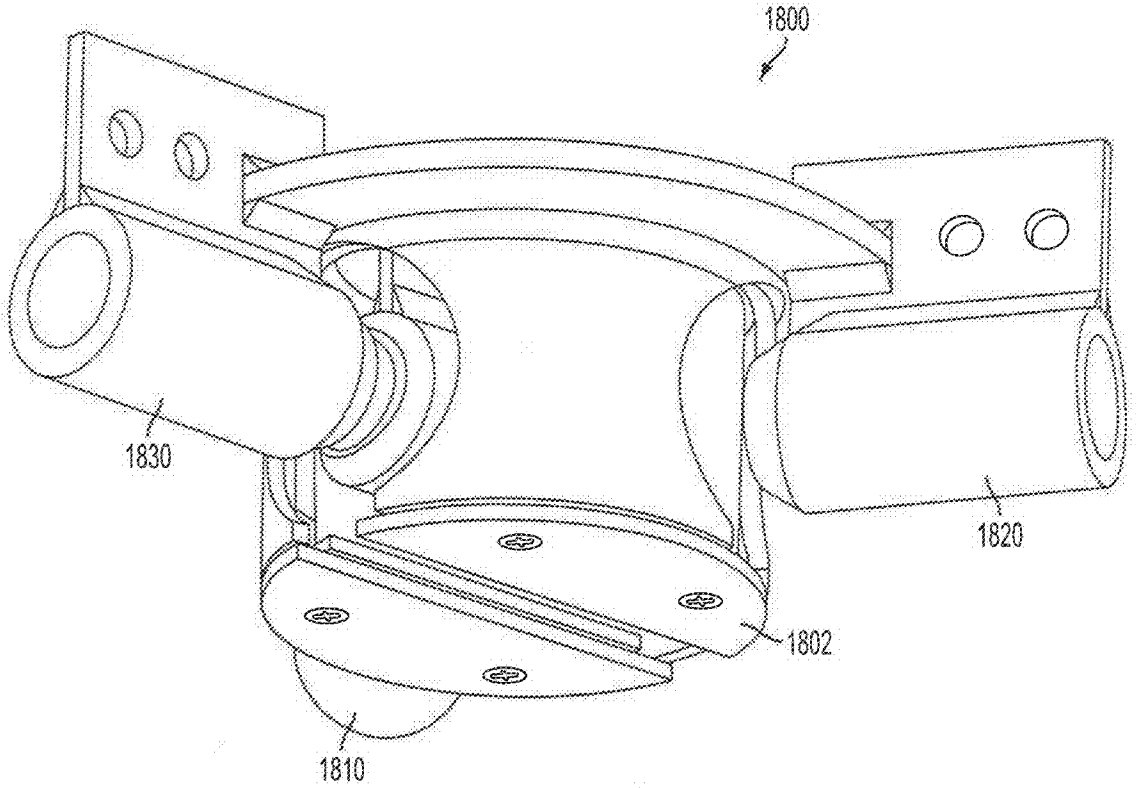
FIG. 18B shows a side perspective view of the slider clamp track with a rotatable component of FIG. 18A for use with a safety or belay mechanism according to one embodiment of the present invention.

FIG. 18A shows a bottom perspective view of a slider clamp track 1800 with a rotatable component 1802 for use with a safety or belay mechanism 1804. The slider clamp track 1800 with the rotatable component 1802 and/or the safety or belay mechanism 1804 may include features that are the same as or similar to those previously discussed, for example, the turntable box 1700. In this fashion, a user may choose a desired track (e.g., tracks 1810, 1820, 1830) for which to travel along while on an amusement attraction, without having to unhook from the safety or belay mechanism 1804 and/or disconnect/reconnect the safety or belay mechanism 1804 between tracks (1810, 1820, 1830). A slot 1850 in the rotatable component 1802 provides access for the downwardly extending portion of the safety or belay mechanism 1804 that cooperates with a lanyard or other connecting element in order to fasten to a user. FIG. 18B shows a perspective view of the slider clamp track element 1800 of FIG. 18A with the rotatable component 1802 for use with a safety or belay mechanism 1804.

Figure 18C:
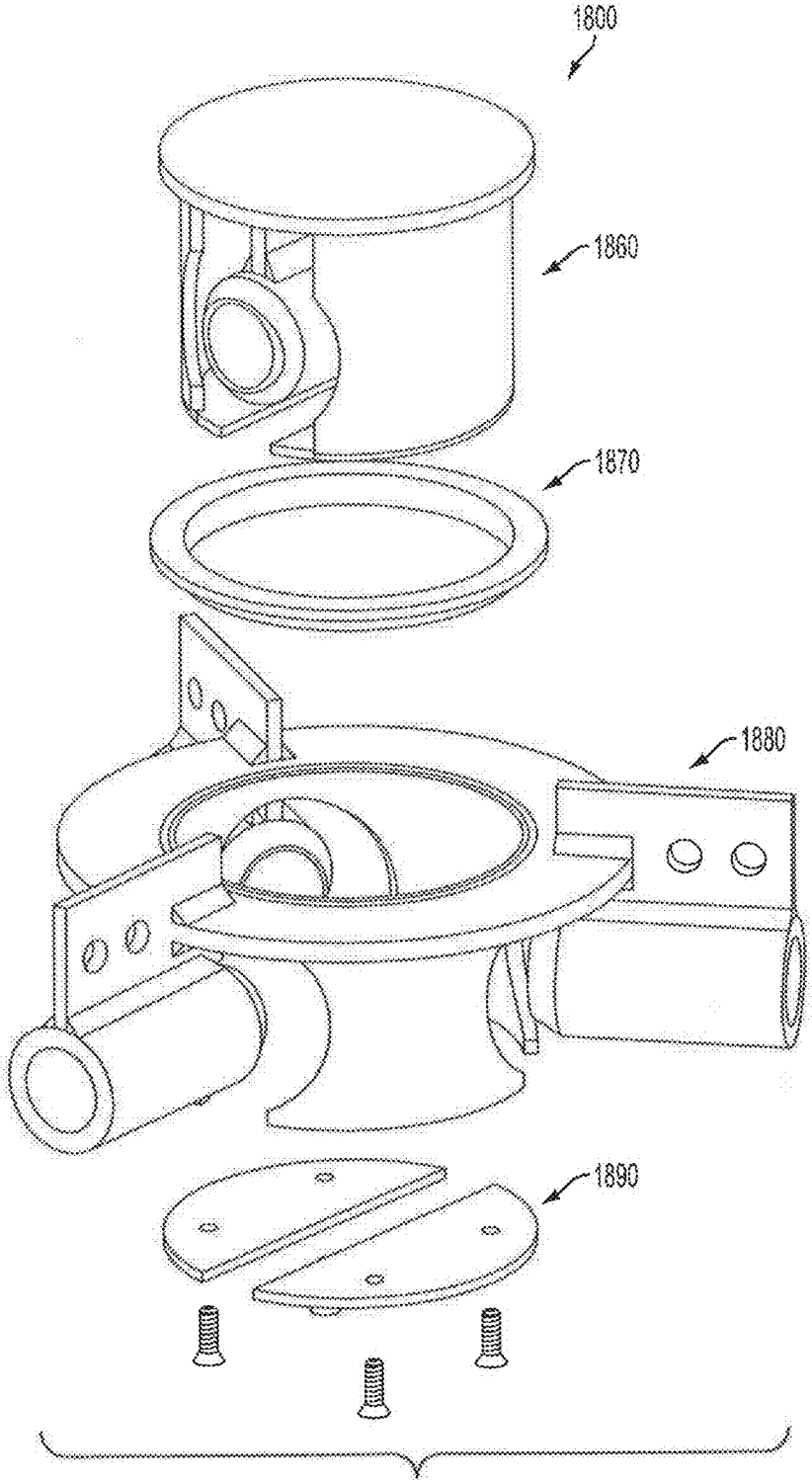
FIG. 18C shows an exploded side perspective view of the slider clamp track with a rotatable component of FIG. 18A for use with a safety or belay mechanism according to one embodiment of the present invention.

FIG. 18C shows an exploded perspective view of the slider clamp track element 1800 with a rotatable component for use with a safety or belay mechanism. As shown, this may include a top component 1860 that mates with a connecting ring 1870 for interaction within a main body component 1880. The main body component 1880 provides an interface with one or more tracks (three illustrated here) that a user may choose to slide therealong using the safety or belay mechanism. The top component 1860 connects with a bottom component 1890 that contains a slot therein (the same as or similar to the previous discussion) which provides space for a downwardly extending portion of the safety or belay mechanism that cooperates with a lanyard or other connecting element in order to fasten to the user. Thus, the top component 1860 and the bottom component 1890 are permitted to rotate with respect to the main body component 1880 (e.g., within an interior perimeter or cutout of the main body component 1880 so that a desired track among a plurality of tracks may be selected for travel.

Figures 19, 19A, 19B, 19C, 19D, 19E:
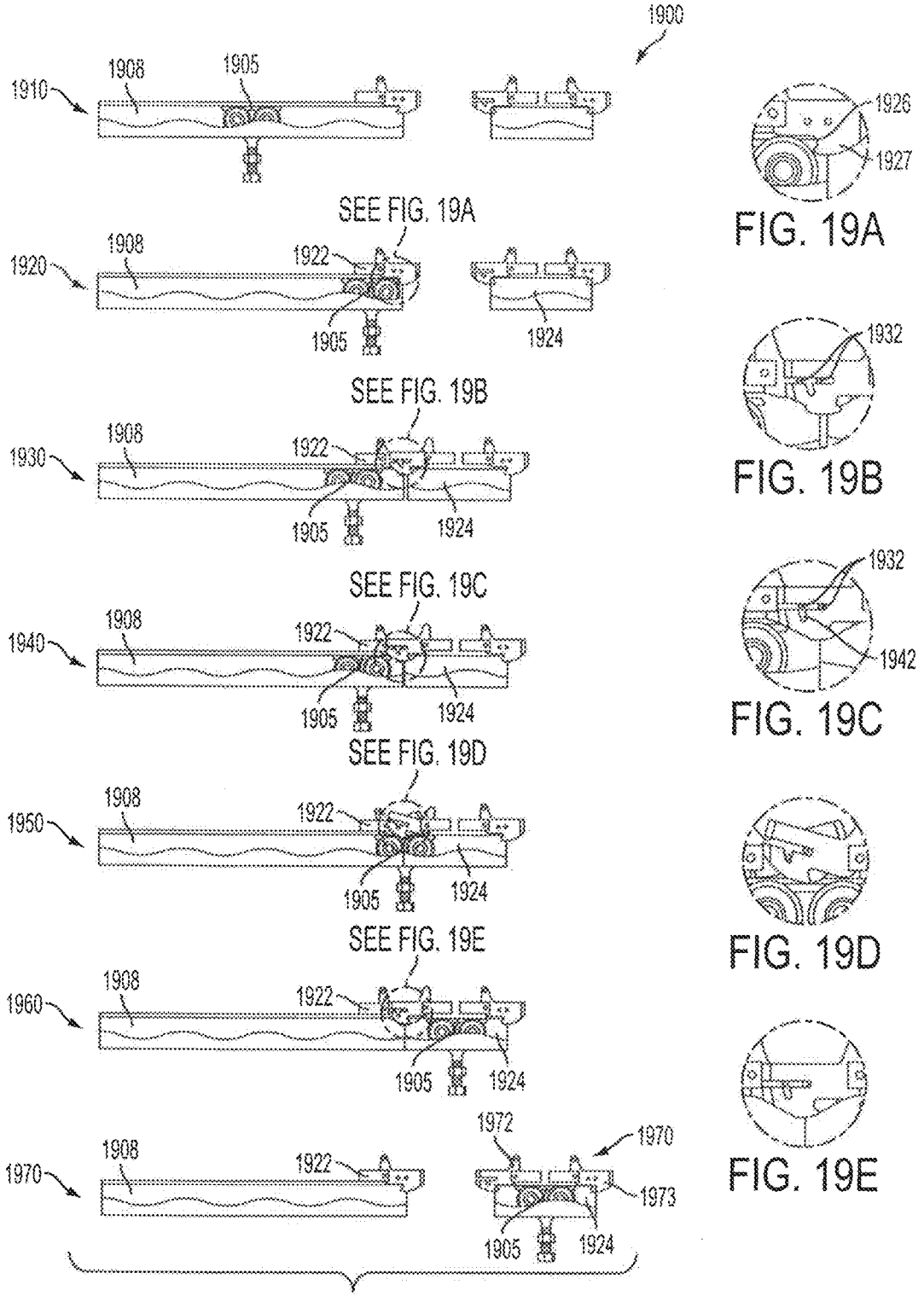
FIG. 19 shows a schematic of handshake operation for an amusement attraction utilizing a safety or belay mechanism according to one embodiment of the present invention.
FIG. 19A shows a zoomed-in portion of the schematic of handshake operation of FIG. 19 according to one embodiment of the present invention.
FIG. 19B shows a zoomed-in portion of the schematic of handshake operation of FIG. 19 according to one embodiment of the present invention.
FIG. 19C shows a zoomed-in portion of the schematic of handshake operation of FIG. 19 according to one embodiment of the present invention.
FIG. 19D shows a zoomed-in portion of the schematic of handshake operation of FIG. 19 according to one embodiment of the present invention.
FIG. 19E shows a zoomed-in portion of the schematic of handshake operation of FIG. 19 according to one embodiment of the present invention.

FIG. 19 and corresponding FIGS. 19A-19E shows a schematic describing a handshake operation 1900 for an amusement attraction utilizing a safety or belay mechanism. At schematic step 1910, a trolley 1905 is located on a fixed, main section of track 1908. At schematic step 1920, at the end of the track 1908 are located one or more spring-loaded end stops 1922 which prevent the trolley 1905 from leaving the track 1908. A nose 1926 on the trolley 1905 engages with a hook 1927 on the one or more end stops 1922 in order to halt the trolley 1905. A mobile track section 1924, used to carry the trolley 1905 from one fixed track to another, or for a variety of other purposes where the trolley 1905 track is desired to be changed, has not yet engaged with the first fixed track 1908. At schematic step 2130, the mobile track section 1924 has moved closer to engagement with the first fixed track 1908, but is not yet fully engaged. One or more pins 1932 on the mobile track section 1924 engage with the end stop 1922 such that rotation of the end stop 1922 is not possible until engagement is complete.

At schematic step 1940, the mobile track section 1924 is fully engaged with the first fixed track 1908. The one or more pins 1932 on the mobile track section 1924 are now aligned such that rotation of at least a portion of the end stop 1922 is permitted via the pin slot 1942. At schematic step 1950, the trolley 1905 may move from the first fixed track 1908 to the mobile track section 1922 due to the rotation of at least a portion of the end stop 1922. At schematic step 1960, the trolley 1905 has passed from the first fixed track 1908 to the mobile track section 1922 and the end stop 1922 may only rotate to a position where the first fixed track 1908 and the mobile track section 1924 can disengage when the trolley 1905 is not present. At schematic step 2170, the mobile track section 1924 moves away, carrying the trolley 1905 with it. The trolley 1905 is secured from falling out of the mobile track by spring-loaded end-stops (1972, 1973) at both ends of the mobile track.

Figure 20:
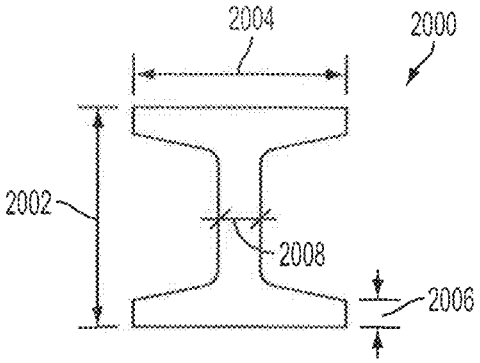
FIG. 20 shows dimension information for an I-beam structural support that may be used in a harnessed course or unharnessed course of an amusement attraction according to one embodiment of the present invention.
Figure 21:
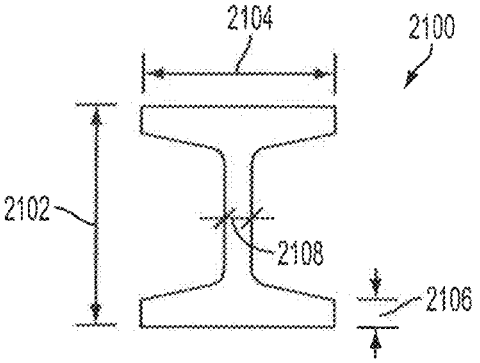
FIG. 21 shows dimension information for an I-beam structural support that may be used in a harnessed course or unharnessed course of an amusement attraction according to one embodiment of the present invention.

FIGS. 20 and 21 shows dimension information for I-beam structural supports that may be used in a harnessed course or unharnessed course of an amusement attraction. The harnessed or unharnessed course of the amusement attraction may include features that are the same as or similar to those previously discussed. For example, an I-beam structural support 2000 may have dimension information such that a total length 2002 is substantially equal to 3 meters, total width 2004 is substantially equal to 2.509 meters, I-height 2006 is substantially equal to 0.260 meters, and I-width 2008 is substantially equal to 0.344 meters. In another example, an I-beam structural support 2100 may have dimension information such that a total length 2102 is substantially equal to 3 meters, total width 2104 is substantially equal to 2.330 meters, I-height 2106 is substantially equal to 0.260 meters, and I-width 2108 is substantially equal to 0.170 meters. Alternative embodiments may use I-beam or other structural supports utilizing the same or different dimension information.

Figure 22:
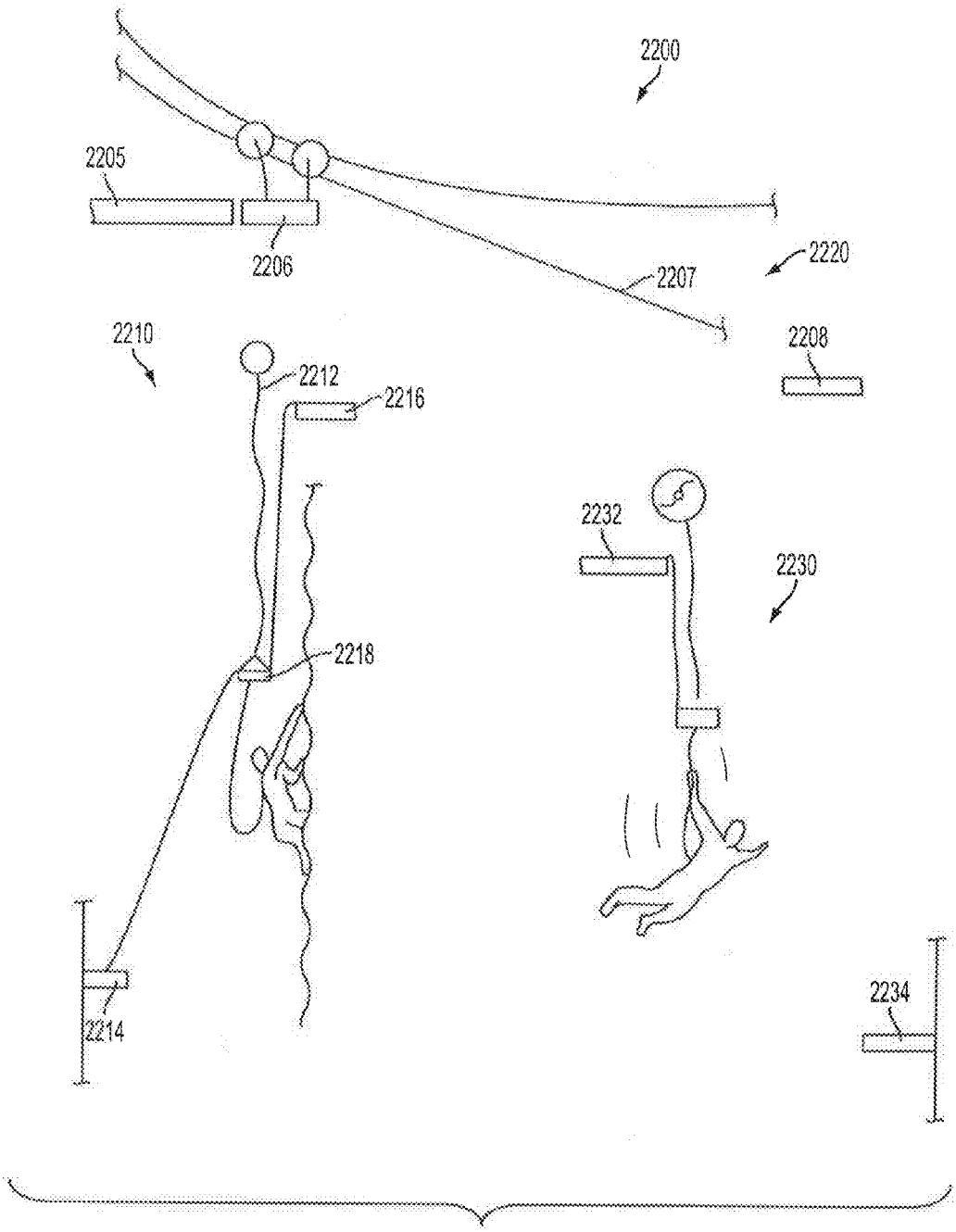
FIG. 22 shows a plurality of harnessed activities that may be performed between sections of track in a harnessed course of an amusement attraction according to one embodiment of the present invention.

FIG. 22 shows a plurality of harnessed activities 2200 that may be performed between sections of track in a harnessed course of an amusement attraction. The harnessed course and/or harnessed activities may include features that are the same as or similar to those previously discussed. For example, vertical climbing 2210 may be permitted from a lower climbing platform 2214 to a higher climbing platform 2216 wherein a safety line is connected with a user and an internal track 2218 extends along a vertical portion of the climbing area. In another example, sliding may be permitted on a zip-line 2320 from a first zip-line platform 2205 to a second zip-line platform 2208 via a safety mechanism 2206 that makes sliding contact with a zip-line track 2207. In still another example, vertical dropping 2230 may be permitted from an upper drop platform 2232 to a lower drop platform 2234. The above activities may be performed by a user on the amusement attraction without having to hook or unhook from a safety system.

Figure 23:
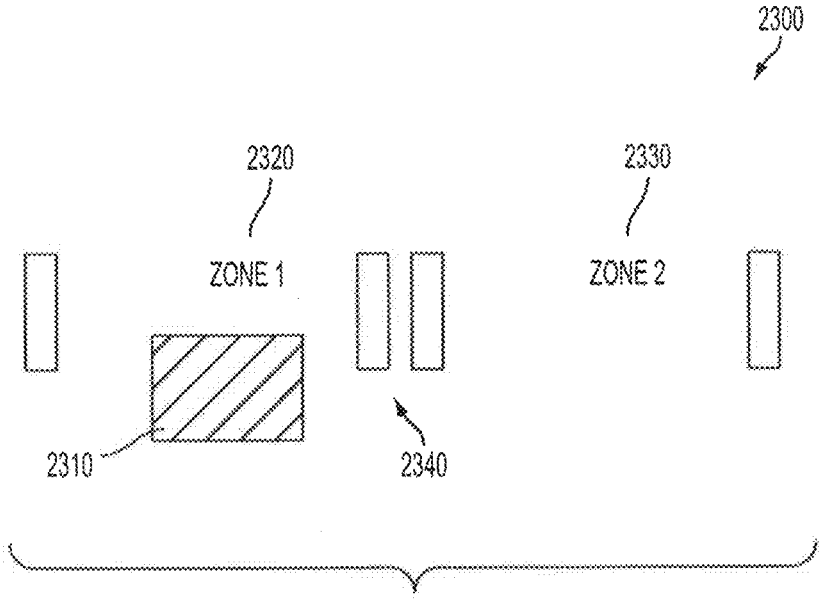
FIG. 23 shows handshaking operation between a trolley and a track according to one embodiment of the present invention.
Figure 24A:
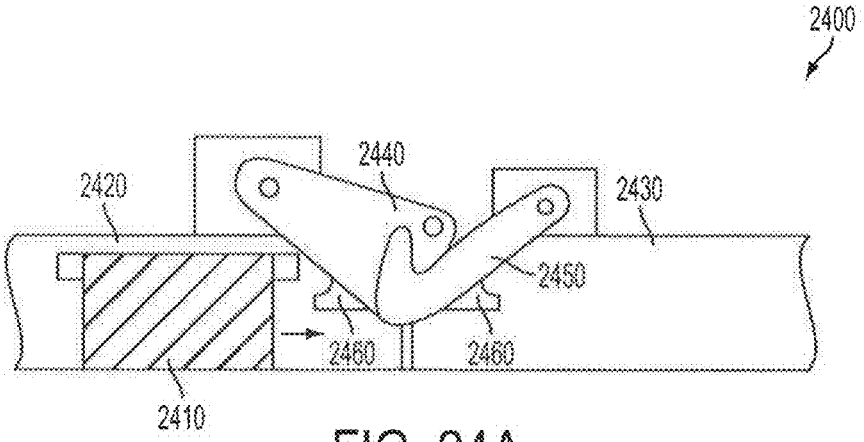
FIG. 24A shows a front view of a handshaking operation between a trolley and a track according to one embodiment of the present invention.
Figure 24B:
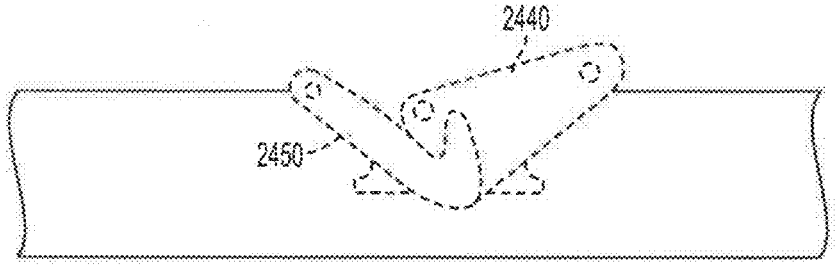
FIG. 24B shows a rear view of the handshaking operation between a trolley and a track of FIG. 24A according to one embodiment of the present invention.
Figure 24C:
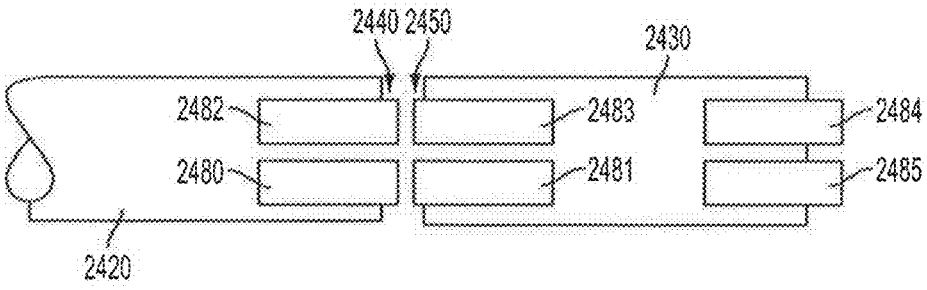
FIG. 24C shows a top view of the handshaking operation between a trolley and a track of FIG. 24A according to one embodiment of the present invention.
Figure 25:
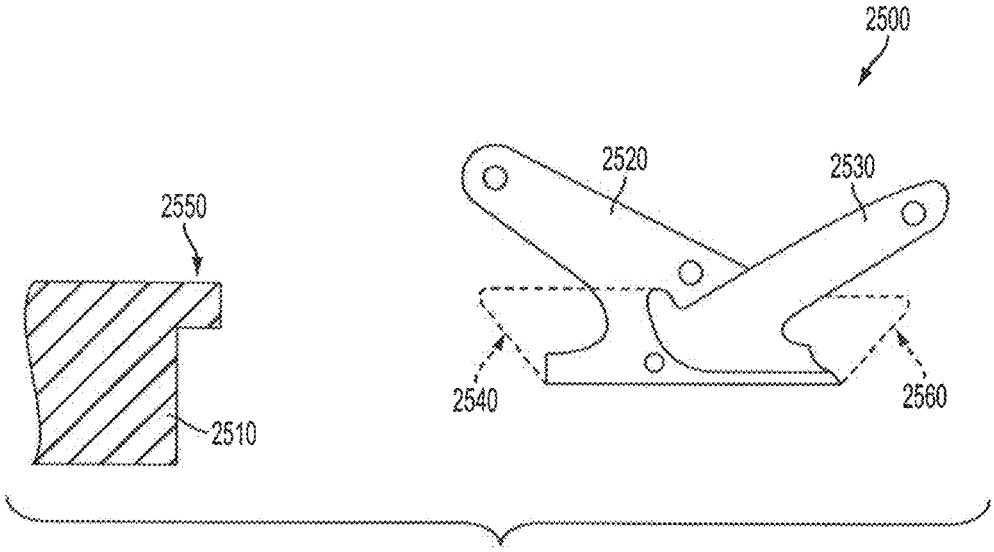
FIG. 25 shows handshaking operation between a trolley and a track according to one embodiment of the present invention.

FIGS. 23-25 illustrate handshaking operation between a trolley and one or more track or track elements. In FIG. 23, a handshaking system 2300 is shown for a trolley 2310 or other safety mechanism. The handshaking operation, trolley 2310 (e.g., safety or belay mechanism), track, and/or track elements may include features that are the same as or similar to those previously discussed. A first zone 2320 (e.g., having a track for movement of the trolley 2310) is separated from a second zone 2330 (e.g., having a track for movement of the trolley 2310) via one or more gates 2340.

In one embodiment, the gates may be physical structures that block movement of the trolley 2310 and/or a user of the trolley 2310 from transitioning between the first zone 2320 and the second zone 2330. In order to increase safety for users during transition, the handshaking system 2300 only allows the one or more gates 2340 to open when they are within a predetermined vicinity to the user and/or the trolley 2310. In addition, the one or more gates 2340 are not permitted to disengage from one another (e.g., if a track in the first zone 2320 and/or the second zone 2330 is a moveable track that moves closer to the first zone 2320 and/or the second zone 2330 to facilitate transfer of the trolley 2310 between the first zone 2320 and the second zone 2330. Lastly, the one or more gates 2340 may be prohibited from closing or otherwise blocking the trolley 2310 if the trolley 2310 is currently transitioning between the first zone 2320 and the second zone 2330.

FIGS. 24A-24C show mechanical operation 2400 of one example of a handshaking system. FIG. 24A shows a front view of the mechanical operation 2400 of the handshaking system, FIG. 24B shows a rear view of the mechanical operation 2400 of the handshaking system, and FIG. 24C shows a top view of the mechanical operation 2400 of the handshaking system. The handshaking operation, trolley (e.g., safety or belay mechanism), track, and/or track elements discussed below may include features that are the same as or similar to those previously discussed. As shown, a trolley 2410 may be configured to move from a first track 2420 to a second track 2430. A first latching component 2440 (e.g., a hook or a loop) coupled with the first track 2420 is configured to engage with a second latching component 2450 (e.g., a corresponding hook or a loop) coupled with the second track 2430. Thus, the first track 2420 and the second track 2430 may be brought within a predetermined and stable distance of one another such that the trolley 2410 can transfer from the first track 2420 to the second track 2430 or vice versa.

The first latching component 2440 and/or the second latching component 2450 may also include one or more teeth 2460, or receptacles in an alternative embodiment, that are configured to engage with a portion of the trolley 2410 for aiding in the movement of the trolley 2410 from one track to another. In one embodiment, the first and/or second latching components (2440, 2450) may be safety systems that are moveable upon the first and/or second tracks (2420, 2430), such that the trolley links with the safety systems that operate or perform other activities of the amusement attraction (e.g., vertical drops, ziplines, etc.). The first latching component 2440 may be comprised of a first hook component 2482 and a first loop component 2480 that are configured to engage or mate with the second latching component 2450, which may be a second loop component 2483 and a second hook component 2484. An alternative embodiment, may utilize different numbers of latching components or latching components with different mechanical operation so long as they are configured to engage with one another. In one example, as shown in FIG. 24C, certain tracks may have latching components at each end of a track segment in certain embodiments.

FIG. 25 shows the mechanical operation 2500 of one example of a latching system for movement of a trolley 2510 between a plurality of tracks. The latching system, trolley (e.g., safety or belay mechanism), track, and/or track elements may include features that are the same as or similar to those previously discussed. As shown, the trolley 2510 may be configured to switch from a first track that is coupled with a first latching element 2520 (e.g., a loop latching component) to a second track that is coupled with a second latching element 2530 (e.g., a hook latching component). The first latching element 2520 and the second latching element 2530 are configured to removeably engage with one another when within a predetermined distance of each other. The second latching element 2530 includes a nose 2540 that is configured to engage with a nub 2550 or other protrusion of the trolley 2510. Thus, after engagement of the nose 2540 with the nub 2550 and transition of the trolley 2510 from the first track to the second track, the first and second tracks, and their corresponding latching elements, may disconnect from one another. The first latching element 2520 may also include a nose 2560 for connecting with a nub of the trolley 2510 in order to facilitate movement of the trolley 2510 from the second track to the first track. In an alternative embodiment, any of a variety of connecting means for the tracks and/or latching elements may be used.

Any of a variety of amusement attractions may be designed that use any or all of the above described concepts. For example, the safety or belay system may attach at any of a variety of locations to a user (e.g., at their waist in front, at their waist in the rear, may be rotatable around their waist utilizing a belt that allows for movement, such as through ball bearings, etc.). In addition, a tracking system (e.g., through the use of biometrics or Radio Frequency Identification (RFID) tags) may be used to provide additional sources of entertainment for users. For example, participants may achieve points or stamps or other rewards based upon their successful completion of various game activities that are tracked by the tracking system of the amusement attraction.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A safety system for coupling a user to an amusement attraction comprising:

a first track;

a second track that is separate from the first track;

a junction box that interfaces with the first track and the second track, the junction box including a transition surface; and a safety mechanism having a support plate, the safety mechanism configured to couple with the user and travel along the first track, the support plate configured to cooperate with the transition surface of the junction box, wherein the safety mechanism is configured to be moveable between the first track and the second track within the junction box based on the support plate cooperating with the transition surface.

2. The safety system of claim 1 wherein the support plate is configured to slide along the transition surface of the junction box.

3. The safety system of claim 2 wherein:

the safety mechanism further comprises a keyhole defined by the support plate;

the junction box further comprises a support track coupled with the junction box, the support track configured to be received by the keyhole when the safety mechanism is sliding along the transition surface of the junction box.

4. The safety system of claim 2 wherein at least a portion of the support plate is coated with a low friction material to facilitate lower friction if sliding along the transition surface of the junction box.

5. The safety system of claim 1 wherein the safety mechanism is configured to slide on an exterior of at least a portion of the first track or the second track.

6. The safety system of claim 5 wherein the safety mechanism further comprising a low friction sleeve coupled with the support plate, the low friction sleeve defining an opening therein for sliding on the exterior of at least the portion of the firs rack or the second track.

7. The safety system of claim 1 wherein the safety mechanism further comprises at least one rotating device, coupled with the support plate, the at least one rotating device configured to rotate on the exterior surface of the first track or the second track.

8. The safety system of claim 7 wherein the safety mechanism includes four wheels coupled with the support plate, each of the four wheels configured to rotate on an exterior surface of the first track or the second track.

9. A safety system for coupling a user to an amusement attraction comprising:

an entrance track;

a first exit track;

a second exit track separate from the first exit track;

a pivoting component coupled with the entrance track, the pivoting component configured to transfer between the first exit track or second exit track for providing a track between the entrance track and the first exit track or the entrance track and the second exit track; and a sliding safety mechanism configured to surround at least a portion of the entrance track, the first exit track, the second exit track, or the pivoting component for sliding along the entrance track, the first exit track, the second exit track, or the pivoting component.

10. The safety system of claim 9 wherein the sliding safety mechanism includes a low friction sleeve, the low friction sleeve defining an opening therein for surrounding at least the portion of the entrance track, the first exit track, the second exit track, or the pivoting component in order to slide on the exterior of at least the portion of the entrance track, the first exit track, the second exit track, or the pivoting component.

11. The safety system of claim 9 wherein the pivoting component is configured to transfer between the first track or the second track in response to manual initiation by the user traversing the entrance track.

12. The safety system of claim 9 wherein the pivoting component is configured to transfer between the first track or the second track in response to an electric signal.

13. The safety system of claim 9 further comprising:

a keying wall coupled with the entrance track, the first exit track, or the second exit track; and a notch disposed in the sliding safety mechanism, the notch configured to receive at least a portion of the keying wall.

14. A safety system for coupling a user to an amusement attraction comprising:

a first track;

a second track separate from the first track;

a junction box that interfaces with the first track and the second track, the junction box having a rotating portion containing a support surface; and a safety mechanism configured to couple with the user and travel along the first track or the second track, an exterior surface of the safety mechanism configured to engage with the support surface of the junction box when the safety mechanism is within the rotating portion of the junction box, wherein the safety mechanism is configured to be moveable between the first track and the second track within the junction box by rotating the rotating portion while the safety mechanism is engaged with the support surface.

15. The safety system of claim 14 wherein the safety mechanism further comprises a wheel, configured to rotate on an exterior surface of the first track or the second track.

16. The safety system of claim 15 wherein the wheel of the safety mechanism only makes contact with the exterior surface of the first track or the second track when the safety mechanism is not within the rotating portion of the junction box.

17. The safety system of claim 16 wherein the safety mechanism is configured to slide on the support surface of the junction box to move from the first track to the second after the wheel loses contact with the exterior surface of the first track and before the wheel makes contact with the exterior surface of the second track.

18. The safety system of claim 14 wherein the safety mechanism further comprises a low friction sleeve defining an opening therein for sliding on at least a portion of an exterior of the first track or the second track.

19. The safety system of claim 14 further comprising a non-harnessed play area of the amusement attraction located adjacent to the first track or the second track such that a user on the first track or the second track may be within a predetermined proximity of a second user in the non-harnessed play area.

* * * * *